US006155910A

United States Patent [19]

Lamphere et al.

[11] Patent Number: 6,155,910

[45] **Date of Patent: *Dec. 5, 2000**

[54] METHOD AND ARTICLE FOR THE PRODUCTION OF OPTICAL QUALITY SURFACES ON GLASS

[75] Inventors: Craig F. Lamphere, Woodbury; Chong Yong Kim, Shoreview; David A. Kaisaki, St. Paul; Heather K. Kranz, Blaine; Julia P. Williams, St. Paul, all of Minn.

[73] Assignee: 3M Innovative Properties Company, St. Paul, Minn.

[ * ] Notice: This patent is subject to a terminal disclaimer.

[21] Appl. No.: 09/400,005

[22] Filed: Sep. 20, 1999

Related U.S. Application Data

[62] Division of application No. 09/197,656, Nov. 23, 1998, Pat. No. 5,989,111, which is a division of application No. 08/778,501, Jan. 3, 1997, Pat. No. 5,876,268.

[51] Int. Cl.[7] ..... B24D 11/00

[52] U.S. Cl. ..... 451/41; 451/59; 451/527; 451/530; 51/295; 51/307

[58] Field of Search ..... 451/36, 41, 59, 451/63, 28, 42, 54, 527, 530, 533; 51/295, 307

[56] References Cited

U.S. PATENT DOCUMENTS

| | | |
|---|---|---|
| 3,188,265 | 6/1965 | Charbonneau et al. . |
| 3,246,430 | 4/1966 | Hurst . |

(List continued on next page.)

FOREIGN PATENT DOCUMENTS

| | | |
|---|---|---|
| 0 291 100 A2 | 11/1988 | European Pat. Off. . |
| 0 345 239 A1 | 12/1989 | European Pat. Off. . |
| 0 400 658 A2 | 12/1990 | European Pat. Off. . |
| 0 655 297 A1 | 5/1995 | European Pat. Off. . |
| 650803 | 5/1995 | European Pat. Off. . |
| 2 330 502 | 6/1977 | France . |
| 63-185 579 | 8/1988 | Japan . |
| 63-196363 | 8/1988 | Japan . |
| 04201181 | 7/1992 | Japan . |
| 06 071 544 | 3/1994 | Japan . |
| 07068469 | 3/1995 | Japan . |
| 2 094 824 | 9/1982 | United Kingdom . |
| WO 95/07797 | 3/1995 | WIPO . |
| WO 95/19242 | 7/1995 | WIPO . |
| WO 95/22436 | 8/1995 | WIPO . |
| WO 95/27595 | 10/1995 | WIPO . |
| WO 97/11484 | 3/1997 | WIPO . |

OTHER PUBLICATIONS

R. Jairath et al., "Role of Consumables in the Chemical Mechanical Polishing (CMP) of Silicon Oxide Films" (undated), 6 pages.

Billmeyer, Jr., F.W., *Text Book of Polymer Science*, Third Edition, Title Page, Table of Contents, pp. v–xvii (1984).

Cook, L.M. "Chemical Processes in Glass Polishing", *J. Non–Crystalline Solids*, 120, 152–171 (1990).

Product Brochure for "Surtronic 3"; Rank Taylor–Hobson, Leicester, England; 3 pgs (undated).

T.R. McGibbon et al., "Surface Finish: A 3–Dimensional View", Brochure of 3M Industrial Abrasives Division, St. Paul, MN, pp. 1–5 (undated).

*Primary Examiner*—Eileen P. Morgan

*Attorney, Agent, or Firm*—Paul W. Busse; Scott A. Bardell

[57] ABSTRACT

The present invention relates to a method and an article for rapidly polishing a glass workpiece surface using a structured abrasive article including cerium oxide particles dispersed in a binder. The abrasive article for rapid polishing of a glass workpiece comprising a backing and at least one polishing layer. The polishing layer comprises cerium oxide particles dispersed within a binder. The binder provides the attachment means of the at least one polishing layer to the backing. The abrasive article is capable of reducing an initial Rtm of about 0.8 μm or greater on a glass test blank to a final Rtm of about 0.3 μm or less in about one minute using an RPE procedure defined herein. The present invention is also directed to a method of polishing a glass workpiece using the present abrasive article.

4 Claims, 2 Drawing Sheets

U.S. PATENT DOCUMENTS 3,401,491 9/1968 Schnabel et al. .
3,594,865 7/1971 Erb .
3,713,796 1/1973 Valerio et al. .
3,991,527 11/1976 Maran .
3,997,527 12/1976 McFarland et al. .
4,255,164 3/1981 Butzke et al. .
4,311,489 1/1982 Kressner .
4,523,411 6/1985 Freerks .
4,529,410 7/1985 Khalakji et al. .
4,563,388 1/1986 Bonk et al. .
4,576,612 3/1986 Shukla et al. .
4,609,581 9/1986 Ott .
4,644,703 2/1987 Kaczmarek et al. .
4,652,274 3/1987 Boettcher et al. .
4,652,275 3/1987 Bloecher et al. .
4,733,502 3/1988 Braun .
4,735,632 4/1988 Oxman et al. .
4,749,617 6/1988 Canty .
4,751,138 6/1988 Tumey et al. .
4,773,920 9/1988 Chasman et al. .
4,799,939 1/1989 Bloecher et al. .
4,903,440 2/1990 Larson et al. .
4,906,523 3/1990 Bilkadi et al. .
4,933,234 6/1990 Kobe et al. .
4,959,265 9/1990 Wood et al. .
5,014,468 5/1991 Ravipati et al. .
5,015,266 5/1991 Yamamoto .
5,077,870 1/1992 Melbye et al. .
5,152,917 10/1992 Pieper et al. .
5,219,462 6/1993 Bruxvoort et al. .
5,236,472 8/1993 Kirk et al. .
5,254,194 10/1993 Ott et al. .
5,256,170 10/1993 Harmer et al. .
5,368,619 11/1994 Culler .
5,435,816 7/1995 Spurgeon et al. .
5,500,273 3/1996 Holmes et al. .
5,505,747 4/1996 Chesley et al. .
5,527,368 6/1996 Supkis et al. .
5,551,960 9/1996 Christianson .
5,580,647 12/1996 Larson et al. .
5,888,119 6/1999 Christianson et al. ..... 451/41
5,910,471 6/1999 Christianson et al. ..... 451/529

METHOD AND ARTICLE FOR THE PRODUCTION OF OPTICAL QUALITY SURFACES ON GLASS

CROSS REFERENCE TO RELATED APPLICATION

This application is a divisional application of application Ser. No. 09/197,656, filed on Nov. 23, 1998, now U.S. Pat. No. 5,989,711; which is a divisional application of application Ser. No. 08/778,501, filed on Jan. 3, 1997, now U.S. Pat. No. 5,876,268, which is incorporated herein by reference.

The present invention relates to a method and an article for rapidly polishing a glass workpiece surface using a fixed abrasive article including cerium oxide particles dispersed in a binder.

BACKGROUND OF THE INVENTION

Glass articles can be extensively found in homes, offices and factories in the form of lenses, prisms, mirrors, CRT tubes, flat display glass, vehicle windshields, computer disc substrates, furniture glass, art glass and the like. The grinding, finishing and polishing of these types of glass objects to an optical clarity is of utmost importance. If present, defects, imperfections, and even minute scratches can inhibit the optical clarity of the glass article and can even inhibit the ability to accurately see through the glass. Thus, it is desired that the glass be essentially free of any defects, imperfections, scratches and be optically clear.

Many optical components contain some type of curve or radius associated with the glass articles. There are several different means to generate a curve/radius on a glass surface. One means is to use abrasive articles and in general, there are three main processes for such shape generation: rough grinding, fining and polishing.

Rough Grinding

The first step is to generate the desired curve or radius by rough grinding the optical component with an abrasive tool. Typically this abrasive tool includes a super-hard abrasive particle such as a diamond, tungsten carbide or cubic boron nitride. The resulting glass surface is usually of the approximate curvature required. The abrasive tool in this rough grinding process will impart course scratches into the glass surface such that the resulting glass surface is neither precise enough nor smooth enough to directly polish to an optically clear state.

Fining

The purpose of the fining step is to refine the coarse scratches generated by the rough grinding process. In general, the fining process removes the deep scratches remaining after rough grinding and provides a substantially smooth, although not polished surface. The fining process should also result in sufficient removal of the coarse scratches such that the glass surface can be polished to an optically clear surface. If the fining process does not remove all the coarse scratches, then it can be extremely difficult for the polishing step to remove these scratches to generate an optically clear surface. In the case of ophthalmic lenses, this fining process is typically done in the presence of a liquid medium such as water, with a conventional coated abrasive article, a lapping coated abrasive article or a combination of conventional coated abrasive and lapping coated abrasive articles. The conventional coated abrasive article includes a backing having a first binder layer, commonly referred to as a make coat, applied over the backing. A plurality of abrasive particles are at least partially embedded into the make coat. Over the abrasive particles/make coat is a second binder layer, commonly referred to as a size coat and this size coat reinforces the abrasive particles. A lapping coated abrasive article includes a backing having an abrasive coating bonded to the backing. This abrasive coating comprises a plurality of abrasive particles dispersed in a binder. There is at least one fining step, typically two or more fining steps, with each subsequent fining step utilizing an abrasive article that contains a smaller or finer abrasive particle size than the previous step. In the case of other glass surfaces, such as CRT tube glass, this fining is typically done with abrasive slurries. Previous attempts in using fixed abrasive articles have, in general, been unsuccessful on a wide scale commercial basis.

The first fining step usually uses abrasive particles with an average particle size of 15 to 40 micrometers depending upon the surface finish produced by the rough grinding step. The second fining step usually uses abrasive particles at least about 50% finer than the first, usually 4 to 12 micrometers. The time required for the two fining steps is usually from about one minute to two minutes per step, depending on the starting surface finish, the abrasive particle size and the desired surface finish. The surface finish of the optical component after this fining process is typically anywhere from about 0.06 to 0.13 micrometer (Ra) and/or an Rtm greater than about 0.40 to 1.4 micrometer.

The roughness of a surface is typically due to scratches or a scratch pattern, which may or may not be visible to the naked eye. A scratch pattern can be defined as a series of peaks and valleys along the surface. Rtm is a common measure of roughness used in the abrasives industry, however, the exact measuring procedure can vary with the type of equipment utilized in surface roughness evaluation. As used herein, Rtm measurements are based on procedures followed with the Rank Taylor Hobson profilometer, available under the trade designation SURTRONIC 3. Within the Rank Taylor Hobson purview, Rt is defined as the maximum peak-to-valley height within an assessment length set by the Rank Taylor Hobson instrument. Rtm is the average, measured over five consecutive assessment lengths, of the maximum peak-to-valley height in each assessment length. Rtm is measured with a profilometer probe, which is a 5 micrometer radius diamond tipped stylus and the results are recorded in micrometers ($\mu$m). In general, the lower the Rtm value, the smoother the finish. A slight variation in the absolute Rtm value can, but not necessarily, occur when the measurement on the same finished glass surface is performed on different brands of commercially available profilometers.

Ra is defined as an average roughness height value of an arithmetic average of the departures of the surface roughness profile from a mean line on the surface, also measured in micrometers ($\mu$m).

Polishing

The third step is the polishing step which generates the optically clear surface on the glass article. In many instances, this polishing step is done with a loose abrasive slurry. Loose abrasive slurries typically comprise a plurality of very fine abrasive particles (i.e., less than about 10 micrometers, usually less than about 5 micrometers) dispersed in a liquid medium such as water. The loose abrasive slurry may optionally contain other additives such as dispersants, lubricants, defoamers and the like. Loose abrasive slurries are usually the preferred means to generate the final polish because of the ability of the loose abrasive slurries to remove essentially all the remaining scratches to generate an optically clear surface that is essentially free of any defects, imperfections and/or minute scratches.

It is well recognized that small differences in Rtm or Ra values can have a significant impact on the clarity of the polished glass surface, i.e., a small difference in Rtm can mean the difference between an optically clear surface and a hazy surface. The input finish to final polishing (i.e., to optical clarity) can also vary widely depending upon the process. For example, starting finishes prior to polishing might have Ra values from about 0.05 to about 0.2 micrometers and Rtm values from about 1.0 to about 2.0 micrometers. Other values outside these ranges may also be encountered prior to polishing.

Polishing machinery utilized depends largely upon the application and the material being polished. For example, ophthalmic lenses may be polished utilizing polishing machines such as a Coburn 5000 or a Coburn 5056 cylinder machine or a Coburn 507 flat lapping machine, all available from Coburn Optical Industries Inc., Muskogee, Okla. These machines rely on a fixed motion, which may be orbital or a figure 8 type motion, of abrasive material while the lens is swept over the abrasive. Pressures of about 35 kPa (5 psi) to about 350 kPa (50 psi) might be used, however, pressures from about 70 kPa (10 psi) to about 210 kPa (30 psi) are typical. The fixed abrasive in this case could have a, so-called, daisy configuration so that the fixed abrasive pad is capable of conforming to a curved polishing arm so that there are no creases or folds in the fixed abrasive pad.

For example, EPO Publication No. 650803 to Lindholm et al. discloses a method for polishing an optical quality surface, such as an ophthalmic lens using abrasive composites, without an abrasive slurry. Essentially all abrasive particles eroded from the abrasive composites are removed from the interface between the surface to be polished and the abrasive article. Erosion of abrasive particles from the abrasive composites brings a continuous supply of new abrasive particles in the abrasive composites into engagement with the first major surface. Thus, polishing is substantially accomplished by the abrasive particles held in the binder, not the eroded abrasive particles.

CRT face panels are currently ground and finished on large rotary hemispherical lappers, utilizing various types of abrasive slurries and pads. The final polish step (i.e., to optical clarity) typically utilizes a ceria slurry on a segmented felt pad. The slurry is pumped on to the pad-glass panel interface. Industrial flat lapping of computer thin film disc wafers is accomplished much the same way by using an precision flat lap (having a diameter from 12 to 60 inches) rather than the hemispherical lap with the abrasive slurry.

Loose abrasive slurries are widely utilized in the final polishing steps of glass articles, however, many disadvantages are associated with them. These disadvantages include the inconvenience of handling the required large volume of the slurry, the required agitation to prevent settling of the abrasive particles and to assure a uniform concentration of abrasive particles at the polishing interface, and the need for additional equipment to prepare, handle, and also recover and recycle the loose abrasive slurry. Additionally, the slurry itself must be periodically analyzed to assure its quality and dispersion stability which requires additional costly man hours. Furthermore, pump heads, valves, feed lines, grinding laps, and other parts of the slurry supply equipment which contact the loose abrasive slurry eventually show undesirable wear. Further, during usage, the polishing operation is usually very untidy because the loose abrasive slurry, which is usually applied as a viscous liquid to a soft pad, splatters easily and is difficult to contain.

Understandably, attempts have been made to replace the loose abrasive slurry polishing systems with lapping coated abrasives to some degree of success. For example, U.S. Pat. Nos. 4,255,164 (Butzke et al.), 4,576,612 (Shukla et al.) and 4,733,502 (Braun) disclose various abrasive articles and polishing processes. Other references that teach lapping coated abrasive articles include U.S. Pat. Nos. 4,644,703 (Kaczmarek et al.); 4,773,920 (Chasman et al.) and 5,014,468 (Ravipati et al.). However, lapping coated abrasives have not commercially replaced loose abrasive slurries. In some instances the lapping coated abrasives do not completely polish the glass article so that the resulting surface is optical clear and essentially free of defects, imperfections and minute scratches. In other instances, the lapping coated abrasives require a longer time to polish the glass article, thereby it is more cost effective to use a loose abrasive slurry.

Much less technical industrial glass is polished offhand. This process typically utilizes a 7 to 12 inch diameter felt buff wheel mounted on a backstand grinder. A ceria-based slurry or compound polish are the abrasives typically used in offhand polishing. Rotational speeds are generally from about 500 to about 1500 rpm with applied pressures of about 70 kPa (10 psi) to about 420 kPa (60 psi). Additionally, random scratches in glass are also removed by offhand polishing using right angle grinders mounting 5 to 10 inch pads with ceria slurries or compounds. As explained above, slurry-based polishing methods exhibit significant disadvantages.

Further, in the past, polishing a glass workpiece has typically required operator training prior to efficient use of currently available polishing matrices, such as abrasive slurries and lapping films. Operator training is of importance because the operator's technique affects polishing matrix breakdown, which results in the liberation of abrasive particles. A slow initial breakdown time results in slower polishing rates. This phenomenon has resulted in poor consumer acceptance of a polishing method using an abrasive cerium oxide pad product from their current methods using buffing pads and ceria slurries or pastes.

Therefore, there is a need for a more user friendly, durable, and rapid method for polishing optical quality glass surfaces, which obviates the need to use an external abrasive slurry or a gel polishing techniques but instead utilizes a fixed abrasive article, thus eliminating time required to polish to optical clarity and reduce the mess generated by the polishing procedure. It is further desired by the glass industry that an abrasive article does not exhibit the disadvantages associated with a loose abrasive slurry yet it is able to effectively polish a glass surface in a reasonable time to optical clarity such that the glass surface is essentially free of imperfections, defects and scratches. Additionally, there exists a need to supply a fixed abrasive article which rapidly breaks down, resulting in faster initial polishing rates and yet has a polishing life at least equal to other polishing pad matrices.

BRIEF SUMMARY OF THE INVENTION

The present invention relates to a method and an article for rapidly polishing a glass workpiece surface using an abrasive article including abrasive particles dispersed within a binder.

The abrasive article for rapid polishing of a glass workpiece comprises a backing and at least one polishing layer. The polishing layer comprises abrasive particles dispersed within a binder. Preferably, the binder is formed from a binder precursor, more preferably the binder precursor includes multi-functional acrylate resin(s), mono-functional acrylate resin(s), and mixtures thereof. The abrasive article is capable of reducing an initial Rtm of about 0.8 μm or greater on a glass test blank to a final Rtm of about 0.3 μm or less in about one minute using an RPE procedure defined herein. The abrasive particles preferably have a chemo-mechanical effect on glass, most preferably the abrasive particles are cerium oxide particles dispersed in a binder.

The "RPE procedure" (RPE) utilizes a COBURN 507 polishing machine, available from Coburn Optical Industries, Inc., Muskogee, Okla., modified to accept a 5 cm (2 inch) diameter glass test blank and the standard abrasive support was replaced with a 10 cm (4 inch) diameter flat aluminum lap. The spindle speed is set at 665 rpm, the sweep stroke is 0 and the orbit stroke length is about 0.78 inch (or set at "7"). The polishing movement of the abrasive support is determined by the polishing machine. All polishing is performed under a slow liquid supply, i.e., applying 0.25 grams of water onto the abrasive article/glass test blank interface every 5 seconds. A typical contact pressure is about 105 kPa (15 psi) at the interface between the abrasive article and the glass test blank. The glass test blanks are PYREX 7740 glass rings, available from Houde Glass Company, Newark, N.J. Each glass ring has an outer diameter of 5.015 cm (2.010 inch), an inner diameter of 4,191 cm (1.650 inch), a height of 1.27 cm (0.5 inch), and a surface area of 13.567 $cm^2$ (1.03 $inch^2$) available for polishing. The surface of each glass test blank can have an initial or input Rtm from about 0.8 to about 1.4 μm prior to polishing to a final Rtm.

Under the RPE procedure, a surface finish on the glass test blank corresponding to optical clarity is achieved using the abrasive article of the present invention in about 1 minute or less, preferably a final Rtm of about 0.30 μm or less is achieved in about 1 minute or less, more preferably a final Rtm of about 0.20 μm or less is achieved in about 1 minute or less, and most preferably a final Rtm of about 0.15 μm is achieved in about 1 minute or less of polishing.

It will be understood that the actual time (or rate) necessary to polish a glass workpiece to optical clarity will vary depending upon a number of factors, such as the polishing apparatus used, the size of the surface area to be polished, the contact pressure, the abrasive particle size, the condition of the initial surface area to be polished, etc. The RPE procedure simply provides a baseline performance characteristic that can be used to compare the present method and article with conventional glass polishing techniques.

The present invention is also directed to a method of polishing a glass workpiece using the present abrasive article. The method includes the steps of providing a glass workpiece having a first surface with an initial Rtm of about 0.8 μm or greater. An abrasive article comprising a sheet-like structure having at least one polishing layer is also provided. The at least one polishing layer comprising cerium oxide particles dispersed in a binder. The abrasive article is capable of reducing an initial Rtm of about 0.8 μm or greater on a test glass blank to a final Rtm of about 0.3 μm or less in about one minute using the RPE procedure. The first surface of the glass workpiece is contacted with the at least one polishing layer of the abrasive. The initial Rtm of the first surface of the glass workpiece is reduced to a final Rtm of about 0.30 μm or less. The step of reducing the initial Rtm of the glass test blank preferably comprises reducing the initial Rtm to a final Rtm of about 0.20 μm or less, and more preferably to a final Rtm of about 0.15 μor less.

In a further embodiment of the invention, the aforesaid sheet-like structure comprises a backing and a plurality of composites, wherein the composites comprise ceria particles and a binder, wherein the binder preferably provides the means of attachment of the composites to the backing layer. Preferably, the binder is formed from a binder precursor and is formed by an addition polymerization mechanism, i.e. a free-radical or cationic polymerization of a binder precursor, and the binder precursor preferably is capable of being polymerized by exposure to radiation energy, along, if necessary, with an appropriate curing agent.

For instance, the binder precursor can be selected from the group of (meth)acrylated urethanes, (meth)acrylated epoxies, ethylenically unsaturated compounds, aminoplast derivatives having pendant α, β-unsaturated carbonyl groups, isocyanurate derivatives having at least one pendant acrylate group, isocyanate derivatives having at least one pendant acrylate group, vinyl ethers, epoxy resins, and mixtures thereof. Preferably, the binder precursor includes multi-functional acrylate resin(s), mono-functional acrylate resin(s) and mixtures thereof.

In yet another embodiment of the invention, the polishing layer includes a plurality of shaped abrasive composites. These abrasive composites can be precisely shaped or irregularly shaped. Preferably, the abrasive composites are precisely shaped.

"Precisely shaped," as used herein, describes the abrasive composites which are formed by curing the binder precursor while the precursor is both being formed on a backing and filling a cavity on the the surface of a production tool. These abrasive composites have a three dimensional shape that is defined by relatively smooth-surfaced sides that are bounded and joined by well-defined sharp edges having distinct edge lengths with distinct endpoints defined by the intersections of the various sides. The abrasive article of this invention is referred to as "structured" in the sense of the deployment of a plurality of such precisely-shaped abrasive.

"Boundary," as used herein, refers to the exposed surfaces and edges of each composite that delimit and define the actual three-dimensional shape of each abrasive composite. These boundaries are readily visible and discernible when a cross-section of an abrasive article of this invention is viewed under a microscope. These boundaries separate and distinguish one abrasive composite from another even if the composites abut each other along a common border at their bases. By comparison, in an abrasive article that does not have a precise shape, the boundaries and edges are not definitive, i.e., the abrasive composite sags before completion of its curing. These abrasive composites, whether precisely or irregularly shaped, can be of any geometrical shape defined by a substantially distinct and discernible boundary, wherein the precise geometrical shape is selected from the group consisting of cubic, prismatic, conical, truncated conical, pyramidal, truncated pyramidal, cylindrical, and the like.

"Texture," as used herein, refers to a polishing layer having any of the aforementioned three dimensional composites, whether the individual three dimensional composites are precisely or irregularly shaped.

"Optically clear surface" refers to a surface that is essentially free of any defects, imperfections and/or minute scratches visible to the naked eye.

In one embodiment of the invention, the aforesaid sheet-like structure includes a backing constituted by a material selected from the group of polymeric film, woven cloth, paper, and nonwoven and treated versions thereof. For example, a backing layer can be composed of a paper layer saturated with an acrylic latex resin and having a thickness of about 255 to 305 micrometers. The backing can also be compressible. Preferably, the backing is a polymeric film.

More preferably, the polymeric film backing has a thickness of about 50 to 100 μm, and most preferably about 75 μm.

BRIEF DESCRIPTION OF SEVERAL VIEWS OF THE DRAWING

Other features, advantages, and further methods of practicing the invention will be better understood from the following description of figures and the preferred embodiments of the present invention.

DETAILED DESCRIPTION OF THE INVENTION

Figure 1:
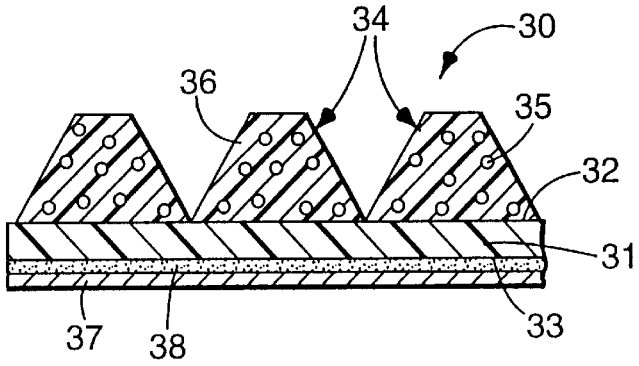
FIG. 1 is an enlarged cross-sectional view of one embodiment of an abrasive article of the present invention.

This invention pertains to a novel method of using an abrasive article in sheet-form for the final polishing step for glass workpieces without the need to use an externally-introduced abrasive grain slurry or gel. Materials suitable for polishing by the invention include, for example, PYREX, quartz, borosilicate, soda lime, tetra-ethyl orthosilicate based glass, lead based glass, and other various types of glass. In particular, there is provided a method for preferably polishing a glass workpiece having an initial Rtm of at least about 0.8 μm to a final Rtm of about 0.30 μm or less, wherein the abrasive article is capable of reducing the initial Rtm of a glass test blank form about 0.80 μm to a final Rtm of about 0.30 μm or less using an RPE procedure. It was surprisingly found that a method for polishing a glass workpiece utilizing an abrasive article including cerium oxide particles dispersed in a binder polishes a surface of a glass workpiece to an optically acceptable clarity in a substantially shorter period of time than abrasive articles currently available.

Such a method is of particular significance in the area of television CRT tube repair, for example. It is highly desirable that a television CRT face panel glass is rapidly replaced after assembly during the television manufacturing process. Equipment in the tube manufacturing plant used to polish such glass typically polishes at a substantially lower pressure than the equipment used in new CRT glass manufacturing, i.e., such polishing may be done by offhand polishers where the operator or technician controls the pressure applied to the surface for polishing. It will be recognized that surface imperfections at this stage of the manufacturing process typically do not encompass the entire CRT glass surface. Therefore, polishing these imperfections will not involve polishing the entire CRT glass surface but will, instead, be a localized polishing process.

In one embodiment, the method includes the steps of providing a glass workpiece having a first surface with an initial Rtm of about 0.8 μm or greater. An abrasive article comprising a sheet-like structure having at least one polishing layer is used to polish the glass workpiece. The at least one polishing layer comprising cerium oxide particles dispersed in a binder. The abrasive article is capable of reducing an initial Rtm of about 0.8 μm or greater on a test glass blank to a final Rtm of about 0.3 μm or less in about one minute using the RPE procedure. The initial Rtm of the first surface of the glass workpiece is reduced to a final Rtm of about 0.30 μm or less. It is believed that an almost immediate breakdown (or break-in), after initial contact between the abrasive article and the glass surface, is typical for the abrasive article of the invention. It is further believed that in this time, an in situ slurry-like state is achieved, including cerium oxide particles from the abrasive composites, fragments of the binder and/or cerium oxide particles adhered to binder fragments liberated from the abrasive article at the interface between the abrasive article and the glass surface.

In one preferred embodiment of the present invention, the binder is formed from a curable binder precursor including multi-functional acrylate resin(s), mono-functional acrylate resin(s) and mixtures thereof. Preferably, the binder is formed from a binder precursor cured by an addition of a polymerization means which is capable of being polymerized by exposure to radiation energy. A curing agent may also be added.

The abrasive article of the present invention may take the form of any suitable shape, such as round, oval or rectangular depending on the particular shape of the lap pad (i.e., the support pad) being employed. In many instances, the abrasive article will be slightly larger in size than the lap pad. An abrasive article may be slotted or slitted, or may be provided with perforations. The sheet material also may be formed into an endless belt by conventional methods by splicing the abutted ends of an elongated strip of the sheet material. Additionally, the abrasive article may be die cut and/or slit to any desired configuration or shape.

Referring to FIG. 1, one embodiment of abrasive article 30 of the invention is illustrated in greater detail and has a backing 31 having a plurality of individual abrasive composites 34 bonded to the front surface 32 of the backing and an attachment system, such as a pressure sensitive adhesive 38, on the back surface 33 of the backing. The abrasive composites 34 comprise a plurality of abrasive particles 35 dispersed in a binder 36. As shown, the abrasive composites 34 have a precise shape, shown here as truncated pyramids. Optional layer 37 is a suitable release liner and can be peeled away to expose the pressure sensitive adhesive (PSA) layer 38 coated on the back surface 33 of the backing 31.

Figure 2:
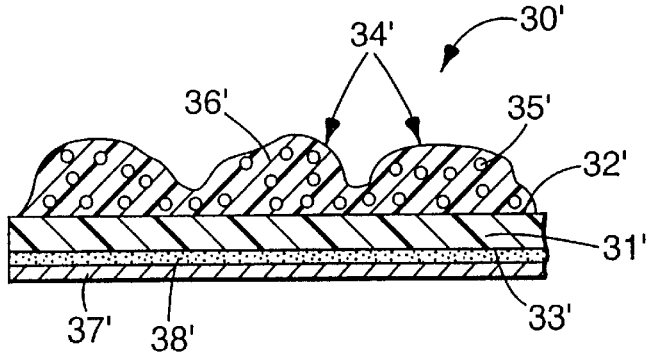
FIG. 2 is an enlarged cross-sectional view of an alternative embodiment of an abrasive article of this invention.

Referring to FIG. 2, another embodiment of abrasive article 30' of the invention is illustrated in greater detail. As shown, abrasive article 30' has a backing 31' having a plurality of individual abrasive composites 34' bonded to the front surface 32' of the backing and an attachment system, such as a pressure sensitive adhesive 38', on the back surface 33' of the backing. The abrasive composites 34' comprise a plurality of abrasive particles 35' dispersed in a binder 36'. As shown, the abrasive composites 34' have an imprecise or irregular shape, shown here as slumped composites. The irregular abrasive composites 34' are not bounded by well-defined shape edges having distinct edge lengths with distinct endpoints. Optional layer 37' is a suitable release liner and can be peeled away to expose the pressure sensitive adhesive (PSA) layer 38' coated on the back surface 33' of the backing 31'.

For purposes of the present invention, the terminology "polishing" means removing previous scratches to provide a fine, mirror-like finish without visually-identifiable scratches in the surface of the glass workpiece. As another criteria of successful polishing in the method of the invention, the polished glass surface has an Rtm value of 0.30 micrometers or less as measured by a SURTRONIC 3 profilometer, available from Rank Taylor Hobson, Leicester, England, having a 5 micrometer radius tip and a cut-off length of about 0.8 mm. This surface finish is needed to ensure that the glass surface is free of wild swirls and deep scratches which would impair the optical properties of the glass surface.

Abrasive Article Backing

Examples of typical backings that can be used for the polishing abrasive article used in the method of this invention include polymeric film, primed polymeric film, cloth, paper, nonwovens and treated versions thereof and combinations thereof. Paper or cloth backings should have a water proofing treatment so that the backing does not appreciably degrade during the polishing operation, as water is typically used to flood the lap means during polishing in the practice of this invention.

One preferred type of backing is polymeric films and examples of such films include polyester films, polyester and co-polyester, microvoided polyester films, polyimide films, polyamide films, polyvinyl alcohol films, polypropylene film, polyethylene film and the like. There should also be good adhesion between the polymeric film backing and the abrasive coating, i.e., the polishing layer. In many instances, the polymeric film backings are primed.

The primer can be a surface alteration or chemical type primer. Examples of surface alterations include corona treatment, UV treatment, electron beam treatment, flame treatment and scuffing to increase the surface area. Examples of chemical type primers include ethylene acrylic acid copolymer as disclosed in U.S. Pat. No. 3,188,265 (Charbonneau et al.), colloidal dispersion as taught in U.S. Pat. No. 4,906,523 (Bilkadi et al.), aziridine type materials as disclosed in U.S. Pat. No. 4,749,617 (Chanty) and radiation grafted primers as taught in U.S. Pat. Nos. 4,563,388 (Bonk et al.) and 4,933,234 (Kobe et al.).

The backing may also have an attachment means on its back surface to secure the resulting coated abrasive to a support pad or back-up pad. This attachment means can be a pressure sensitive adhesive (PSA) or tape, a loop fabric for a hook and loop attachment, or an intermeshing attachment system.

Abrasive Composite

The preferred abrasive article for use with the present invention employs an array of individual abrasive composites, each composite comprising abrasive particles dispersed in a binder system, as opposed to a continuous polishing layer of abrasive particles dispersed in a binder. It is preferred that the composites be three dimensional, have work surfaces which do not form part of an integral layer and that present independent acting grinding surfaces from other composites during usage. The abrasive article used in this invention can be a beaded type abrasive article or a so-called "structured abrasive article." A structured abrasive article means an abrasive article wherein a plurality of individual precisely-shaped composites are disposed on a backing, each composite comprising abrasive particles dispersed in a binder. A beaded-type abrasive article has generally spherical, and usually hollow, shells of binder and abrasive particles. These beads are then bonded to a backing with a binder. However, the beaded-type abrasive is less preferred. However, the textured abrasive, either precisely or irregularly shaped abrasives as described above or beaded abrasives, provides room for debris removal, provides room for fluid interaction, possesses a higher unit pressure/composite breakdown, and creates less "stiction" than the beaded-type abrasive than a continuous polishing layer of a lapping film.

During use of the abrasive article used in polishing of a glass surface for this invention, the abrasive composites gradually erode. This erodibility rate depends upon many factors including the abrasive composite formulation and the polishing conditions. Regarding the abrasive composite formulation, the abrasive particle type, abrasive particle size, binder type, optional additives, individually or in combination, can effect the erodibility of the abrasive composite. For instance, harder binders, such as phenolic binders, are less erodible than softer binders, such as aliphatic epoxy binders. Alternatively, certain additives or fillers, such as glass bubbles, tend to make the abrasive composite more erodible.

Abrasive Particles

The abrasive composites of the abrasive article of the invention preferably include abrasive particles dispersed in a binder. The abrasive particles are preferably cerium oxide, or ceria, rare earth compounds, or mixtures thereof. Such rare earth compounds suitable for polishing can be found in U.S. Pat. No. 4,529,410 (Khaladji et al.). It is believed that such abrasive particles may provide a chemo-mechanical element to the polishing procedure. As used herein, chemo-mechanical refers to a dual mechanism where corrosion chemistry and fracture mechanics both play a role in glass polishing. In particular, it is believed that abrasive particles such as cerium oxide and zirconium oxide, for example, provide a chemical element to the polishing phenomenon as discussed in Cook, L. M., "Chemical Processes in Glass Polishing," 120 *J. of Non-Crystalline Solids* 152–171, Elsevier Science Publ. B.V. (1990). While not being bound by a particular theory, it is suggested that, at least for aqueous slurries, polishing rates may be related to the rate of molecular water diffusion into the glass surface, subsequent glass dissolution under the load imposed by the polishing particle, the adsorption rate of dissolution products onto the surface of the polishing grain, the rate of silica redisposition back onto the glass surface, and the aqueous corrosion rate between particle impacts.

The abrasive particles may be uniformly dispersed in the binder or alternatively the abrasive particles may be non-uniformly dispersed. It is preferred that the abrasive particles are uniformly dispersed so that the resulting abrasive coating provides a consistent cutting/polishing ability.

For glass-surface polishing, it is preferred that average particle size of the abrasive particles is from about 0.001 to 20 micrometers, typically between 0.01 to 10 micrometers. In some instances, the abrasive particles preferably have an average particle size less than 0.1 micrometer. In other instances, it is preferred that the particle size distribution results in no or relatively few abrasive particles that have a particle size greater than about 2 micrometers, preferably less than about 1 micrometer and more preferably less than about 0.75 micrometers. At these relatively small particle sizes, the abrasive particles may tend to aggregate by interparticle attraction forces. Thus, these aggregates may have a particle size greater than about 1 or 2 micrometers and even as high as 5 or 10 micrometers. It is then preferred to break up these aggregates to an average size of about 2 micrometers or less. However, in some instances, it can be difficult to "break" up these aggregates. Additionally, these very small abrasive particles are dispersed in a liquid prior to addition to the binder precursor. This dispersion can be in water or in a basic or acidic liquid. Further, this liquid may also include a surfactant, coupling agent or wetting agent. In some instances, it is preferred that the particle size distribution be tightly controlled such that the resulting abrasive article provides a very consistent surface finish on the glass surface after polishing.

The abrasive article for use in the method of the invention may optionally include other abrasive particles in addition to cerium oxide. The optional abrasive particles can either be hard or soft inorganic abrasive particles, or mixtures thereof. Examples of hard abrasive particles include aluminum oxide, heat treated aluminum oxide, white fuse aluminum oxide, black silicon carbide, green silicon carbide, titanium diboride, boron carbide, tungsten carbide, titanium carbide, diamond, cubic boron nitride, garnet, fused alumina zirconia, sol gel abrasive particles and the like.

Soft inorganic particles include silica, chromia, iron oxide, zirconia, titania, silicates and tin oxide. The abrasive article may include a mixture of two or more different abrasive particles. This mixture may include a mixture of hard inorganic abrasive particles and soft inorganic abrasive particles. In a mixture of two or more different abrasive particles, the individual abrasive particles may have the same average particle size, or alternatively the individual abrasive particles may have a different average particle size. For example, the abrasive article of the invention can include cerium oxide particles and other rare earth oxides, such as zirconia, silica and the like. It is preferred that any optional abrasive particles do not hinder the polish properties of the cerium oxide by, for example, creating wild scratches.

It is also within the scope of this invention to have a surface coating top coated upon the abrasive particles. The surface coating may have many different functions. In some instances the surface coatings increase adhesion to the binder, alter the abrading characteristics of the abrasive particle and the like.

Additives

The polishing layer may further contain optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired.

Examples of fillers used only for their effects on erodibility include, but are not limited to glass bubbles, alumina bubbles, polymer spheres, clay bubbles, marble, marl, gypsum, chalk, coral, coquina, oolite.

A coupling agent can provide an association bridge between the binder precursor and the filler particles or abrasive particles. Examples of coupling agents include silanes, titanates, and zircoaluminates. Also, the abrasive slurry preferably contains from about 0.01 to 3% by weight coupling agent.

An example of a suspending agent is an amorphous silica particle having a surface area less than 150 meters square/gram that is commercially available from DeGussa Corp., under the trade names "Aerosil 130" or "OX-50".

Binder

The abrasive particles are dispersed in a binder to form the abrasive composite. The binder includes a thermosetting or crosslinking binder, and preferably a binder curable by an addition (chain reaction) polymerization. The use in this invention of binder systems which cure via an addition mechanism provides the advantage of being able to be rapidly and controllably cured by exposure to radiation energy to permit a high rate of production while affording a high degree of control over ultimate shape of the abrasive composites. The thermosetting binder preferably is formed from a binder, or polymeric, precursor.

Abrasive particles are mixed with the binder precursor to form an abrasive slurry. During the manufacture of the abrasive article, the abrasive slurry is exposed to an energy source which aids in the initiation of the polymerization or curing process of the binder precursor. Examples of energy sources include thermal energy and radiation energy which includes electron beam, ultraviolet light, and visible light.

Examples of suitable binder precursors which are curable via an addition (chain reaction) mechanism include binder precursors that polymerize via a free radical mechanism or, alternatively, via a cationic mechanism. These terms, such as "addition" or "chain-reaction" mechanism, polymerization via a "free radical" or a "cationic" mechanism, have well known meanings, such as are explained in the Textbook of Polymer Science, third edition, F. Billmeyer, jr., John Wiley & Sons, New York, N.Y., 1984.

More particularly, suitable binder precursors for this invention which polymerize via free radical mechanism include acrylated urethanes, acrylated epoxies, ethylenically unsaturated compounds including acrylate monomer resin (s), aminoplast derivatives having pendant $\alpha,\beta$-unsaturated carbonyl groups, isocyanurate derivatives having at least one pendant acrylate group, isocyanate derivatives having at least one pendant acrylate group, epoxy resins, and mixtures and combinations thereof. The term acrylate encompasses acrylates and methacrylates.

The ethylenically unsaturated monomers or oligomers, or acrylate monomers or oligomers may be mono-functional, difunctional, trifunctional or tetra-functional or even higher functionality. Ethylenically unsaturated binder precursors include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups.

Ethylenically unsaturated compounds preferably have a molecular weight of less than about 4,000 and are preferably esters made from the reaction compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl) isocyanurate, 1,3,5-tri(2-methylacryloxyethyl)-s-triazine, acrylamide, methacrylamide, N-methyl-acrylamide, N,N-dimethylacrylamide, N-vinyl-pyrrolidone, N-vinyl-piperidone, and CMD 3700, available from Radcure Specialities. Example of ethylenically unsaturated diluents or monomers can be found in U.S. Pat. Nos. 5,236,472 (Kirk et al.) and 5,580,647 (Larson et al.). Additional information concerning binders and binder precursors can be found in assignee's copending patent application Ser. No. 08/694,014, filed Aug. 8, 1996, which is a continuation-in-part of patent application Ser. No. 08/557,727, filed Nov. 11, 1995, (Bruxvoort et al.) and U.S. Pat. No. 4,773,920 (Chasman et al.).

One preferred binder precursor of the invention includes a mixture of a multi-functional acrylate resin(s) with a mono-functional acrylate resin(s). The multi-functional acrylate resins(s) can be a tri-functional acrylate monomer resin, a tetra-functional acrylate monomer resin, or a combination of a tri-functional and tetra-functional acrylate monomer resins. Although not wishing to be bound by theory, it is believed that this combination of a crosslinked multi-functional acrylate resin(s) and a mono-functional acrylate resin(s) provides a binder/resin system that tends to be brittle. It is believed that such a binder shatters, disintegrates, fractures, fragments, splinters and imparts the desired erodibility properties of the abrasive composites of the abrasive article for glass polishing in the present invention. It is further believed that the brittle binder creates in situ slurry-like state at the interface between the abrasive article and the glass surface. The slurry includes cerium oxide particles, fragments of the binder and/or cerium oxide particles adhered to binder fragments liberated from the abrasive article.

In general, the weight ratio between these acrylate resin(s) ranges between about 5 to about 95 parts multi-functional acrylate monomer to about 95 to 5 parts mono-functional acrylate monomer, preferably from 25 to about 75 parts multi-functional acrylate monomer to about 75 to 25 parts mono-functional acrylate monomer, more preferably from 40 to about 60 parts multi-functional acrylate monomer to about 60 to 40 parts mono-functional acrylate monomer, and most preferably about 50 parts multi-functional acrylate monomer to about 50 parts mono-functional acrylate monomer.

The abrasive coating can include by weight from about 1 to 90 parts abrasive particles to about 99 to 10 parts binder. Preferably, the abrasive coating includes from about 30 to 85 parts abrasive particles to about 70 to 15 parts binder, more preferably from 40 to 70 parts abrasive particles to about 30 to 60 parts binder.

Additive

The abrasive coating may also include one or more additives that can generally be categorized as a curing agent. A curing agent is a material that helps to initiate and complete the polymerization or crosslinking process such that the binder precursor is converted into a binder. The term curing agent encompasses initiators, photoinitiators, catalysts and activators. The amount and type of the curing agent will depend largely on the chemistry of the binder precursor.

Free Radical Initiators

Polymerization of the preferred ethylenically unsaturated monomer(s) or oligomer(s) occurs via a free-radical mechanism. If the energy source is an electron beam, the electron beam generates free-radicals which initiate polymerization. However, it is within the scope of this invention to use initiators even if the binder precursor is exposed to an electron beam. If the energy source is heat, ultraviolet light, or visible light, an initiator may have to be present in order to generate free-radicals. Examples of initiators (i.e., photoinitiators) that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. An example of a commercially available photoinitiator that generates free radicals upon exposure to ultraviolet light include IGRACURE 651 and IGRACURE 184 both commercially available from the Ciba Geigy Company and DAROCUR 1173 commercially available from Merck. Examples of initiators that generate free-radicals upon exposure to visible light can be found in U.S. Pat. No. 4,735,632. Another photoinitiator that generates free-radicals upon exposure to visible light has the trade name IRGACURE 369, commercially available from Ciba Geigy Company.

Typically, the initiator is used in amounts ranging from 0.1 to 10%, preferably 2 to 4% by weight, based on the weight of the binder precursor. Additionally, it is preferred to disperse, preferably uniformly disperse, the initiator in the binder precursor prior to the addition of any particulate material, such as the abrasive particles and/or filler particles.

In general, it is preferred that the binder precursor be exposed to radiation energy, preferably ultraviolet light or visible light. In some instances, certain abrasive particles and/or certain additives will absorb ultraviolet and visible light, which makes it difficult to properly cure the binder precursor. This phenomena is especially true with ceria abrasive particles and silicon carbide abrasive particles. It has been found, quite unexpectedly, that the use of phosphate containing photoinitiators, in particular acylphosphine oxide containing photoinitiators, tend to overcome this problem. An example of such a photoinitiator is 2,4,6-trimethylbenzoyldiphenylphosphine oxide which is commercially available from BASF Corporation, Charlotte, N.C., under the trade designation LUCIRIN TPO. Other examples of commercially available acylphosphine oxides include DAROCUR 4263 and DAROCUR 4265, both commercially available from Merck.

Photosensitizers

Optionally, the curable compositions may contain photosensitizers or photoinitiator systems which affect polymerization either in air or in an inert atmosphere, such as nitrogen. These photosensitizers or photoinitiator systems include compounds having carbonyl groups or tertiary amino groups and mixtures thereof. Among the preferred compounds having carbonyl groups are benzophenone, acetophenone, benzil, benzaldehyde, o-chlorobenzaldehyde, xanthone, thioxanthone, 9,10-anthraquinone, and other aromatic ketones which can act as photosensitizers. Among the preferred tertiary amines are methyldiethanolamine, ethyldiethanolamine, triethanolamine, phenylmethylethanolamine, and dimethylaminoethylbenzoate. In general, the amount of photosensitizer or photoinitiator system may vary from about 0.01 to 10% by weight, more preferably from 0.25 to 4.0% by weight, based on the weight of the binder precursor. Examples of photosensitizers include QUANTICURE ITX, QUANTICURE QTX, QUANTICURE PTX, and QUANTICURE EPD all commercially available from Biddle Sawyer Corp.

Plasticizer

The abrasive coating may optionally include a plasticizer. In general, the addition of the plasticizer will increase the erodibility of the abrasive coating and soften the overall binder hardness, if used. The plasticizer should be in general compatible with the binder such that there is no phase separation. Examples of plasticizers include polyvinyl chloride, dibutyl phthalate, alkyl benzyl phthalate, polyvinyl acetate, polyvinyl alcohol, cellulose esters, phthalate, silicone oils, adipate and sebacate esters, polyols, polyols derivatives, t-butylphenyl diphenyl phosphate, tricresyl phosphate, castor oil, combinations thereof and the like. In general, the amount of plasticizer may vary from about 15% by weight or less, more preferably from about 10% to about 5% by weight, and most preferably from about 2% to about 0% by weight.

Filler

The polishing coating and optionally include a filler. The filler may alter the erodibility of the abrasive composites. A filler is a particulate material and generally has an average particle size range from about 0.1 to about 50 micrometers, typically from about 1 to 30 micrometers. Examples of useful fillers for this invention include metal carbonates (such as calcium carbonate, i.e., chalk, calcite, marl, travertine, marble and limestone), calcium magnesium carbonate, sodium carbonate, magnesium carbonate, silica (such as quartz, glass beads, glass bubbles and glass fibers), silicates (such as talc, clays, [montmorillonite] feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide [lime], aluminum oxide, tin oxide, stannic oxide, titanium dioxide), metal sulfites (e.g., calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles), and thermosetting particles (such as phenolic bubbles, phenolic beads, polyurethane foam particles). Fillers can also include halide salts including sodium chloride, potassium cryolite, sodium cryolite, ammonium cryolite, potassium tetrafluoroborate, sodium tetrafluoroborate, silicon fluorides, potassium chloride, magnesium chloride, and the like. Metals can also be used as fillers, such as tin, lead, bismuth, cobalt, antimony, cadmium, iron, titanium, and the like. Other miscellaneous fillers include sulfur, organic sulfur compounds, graphite, metallic sulfides, and the like.

Abrasive Composite Construction

In accordance with the invention, the polishing layer includes an abrasive construction wherein the abrasive coating of abrasive particles and binder precursor, described above, is formed into a plurality of shaped abrasive composites. Each of these shaped abrasive composites can have either a precise shape or an irregular shape. In one embodiment, each abrasive composite has a precise shape associated with it. The shape has a surface or boundary associated with it that results in one abrasive composite being separated to some degree from another adjacent abrasive composite. That is, to form an individual abrasive composite, the planes and boundaries forming the shape of the abrasive composite must be separated from one another at least at the distal ends at the upper portions of the abrasive composite shapes.

These distal ends can all extend to a common imaginary plane extending parallel to the backing, or can have independent heights from each other. The lower or bottom portion of abrasive composites, but not inclusive of the distal ends, can abut one another or can be spaced apart some predetermined distance. It is to be understood that the definition of abut also covers an arrangement where adjacent composites share a common abrasive material land or bridge-like structure which contacts and extends between facing sidewalls of the abrasive composites. The abrasive material land is formed from the same abrasive slurry (abrasive coating or polishing layer) used to form the abrasive composites. The composites are "adjacent" in the sense that no intervening composite is located on a direct imaginary line drawn between the centers of the composites. In one embodiment of the invention, the abrasive composites are "individual" in the sense that at least the distal ends of different composites do not interconnect. It is theorized that this separation provides a means to allow the fluid medium to freely flow between the abrasive composites. It is then believed that this free-flow of the fluid medium tends to contribute to a better cut rate surface finish or increased flatness during glass polishing. For instance, referring to FIG. 1, adjacent abrasive composites 34 are separated near the top surface and abutted near the bottom surface. The spacing of the abrasive composites can vary from about 1 composite per linear cm to about 100 composites per linear cm, preferably from about 5 composite per linear cm to about 80 composites per linear cm, more preferably from about 10 composite per linear cm to about 60 composites per linear cm, and most preferably from about 15 composite per linear cm to about 50 composites per linear cm.

In one embodiment of the invention, there is an area spacing of at least about 5 composites/cm$^2$, preferably at least about 100 composites/cm$^2$, more preferably at least about 500 composites/cm$^2$, and more preferably at least about 1,200 composites/cm$^2$. In another embodiment of the invention, the area spacing of composites ranges from about 1 to about 12,000 composites/cm$^2$, preferably ranges from about 50 to about 7,500 composites/cm$^2$, and more preferably ranges from about 50 to about 5,000 composites/cm$^2$.

The individual abrasive composite shapes can be any three dimensional shape, but it is preferably a geometric shape such as cylinder, sphere, pyramid, truncated pyramid, cone, truncated cone, prism, cube, or a post-like feature having a top surface shape of triangle, square, rectangle, hexagon, octagon, or the like. Another shape is hemispherical and this is further described in commonly assigned PCT Publication No. WO 95/22436 (Hoopman), published Aug. 24, 1995. Also, the resulting abrasive article can have a mixture of different abrasive composite shape. However, it is possible that the plurality of abrasive composites have substantially the same shape but the orientation of the individual abrasive composites may be different from one another.

One preferred shape is a pyramid or truncated pyramid. The pyramidal shape preferably has four to five sides if untruncated and five to six sides if truncated (inclusive of the base side), although a larger number of sides also is within the scope of the invention. It is preferred to provide a height of the composites which is constant across the abrasive article, but is possible to have composites of varying heights. The height of the composites can be a value from about 10 to about 1000 micrometers, preferably about 25 to about 500 micrometers, more preferably from about 40 to about 150 micrometers and most preferably from about 50 to about 80 micrometers. Where a pyramidal or truncated pyramidal shape is used, the base sides generally can have a length of from about 100 to 500 micrometers. The sides forming the abrasive composites may be straight or they can be tapered. If the sides are tapered, it is easier to remove the abrasive composite from the cavities of the production tool. The angle forming the taper can range from about 1 to about 75 degrees, preferably from about 2 to 50 degrees, more preferably from about 3 to 35 degrees, and most preferably from about 5 to 15 degrees.

The individual abrasive composites alternatively can be provided as abrasive agglomerates or beads. These abrasive agglomerates are generally of the types described in U.S. Pat. Nos, 4,311,489 (Kressner); 4,652,275 (Bloecher et al.); 4,799,939 (Bloecher et al.), and 5,500,273 (Holmes et al.) which are incorporated herein by reference, but which are modified for purposes of this invention to increase the erodibility of the composite by means described herein.

Method of Making a Precise-Shaped Abrasive Composite

Figure 3:
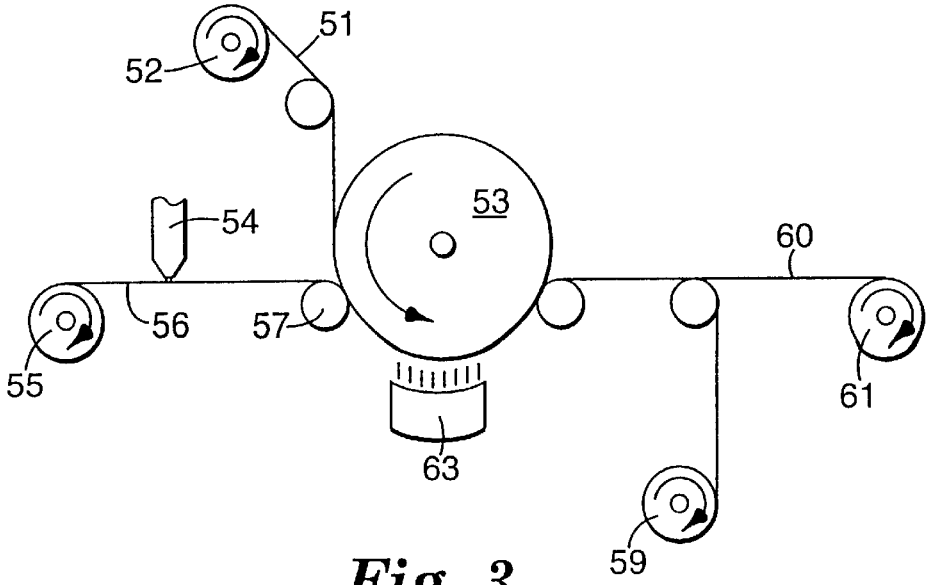
FIG. 3 is a schematic view of a system for making an abrasive article for use in this invention.

FIG. 3 is a schematic to manufacture one preferred abrasive article for use with this present invention. The first step to make the preferred abrasive article is to prepare the abrasive slurry. The abrasive slurry is made by combining together by any suitable mixing technique the binder precursor, the abrasive particles and the optional additives. Examples of mixing techniques include low shear and high shear mixing, with high shear mixing being preferred. The amount of air bubbles in the abrasive slurry can be minimized by pulling a vacuum during the mixing step. It is important that the abrasive slurry have a rheology that coats well and in which the abrasive particles and other additives do not settle out of the abrasive slurry. Any known techniques to improve the coatability, such as ultrasonics or heating can be used.

A first method generally results in an abrasive composite that has a precise shape. To obtain the precise shape, the binder precursor is solidified or cured while the abrasive slurry is present in cavities of a production tool. A second method generally results in an abrasive composite that has an irregular shape. It this method, the production tool is removed from the binder precursor prior to curing, resulting in a slumped, irregular shape.

The preferred method of producing the abrasive article to form precisely-shaped abrasive composites uses a production tool containing a plurality of cavities. These cavities are essentially the inverse shape of the desired abrasive composite and are responsible for generating the shape of the abrasive composites. The number of cavities results in the abrasive article having a corresponding number of abrasive composites/square unit area. These cavities can have any geometric shape such as a cylinder, dome, pyramid, truncated pyramid, prism, cube, cone, truncated cone or a post-like feature having a top surface shape of triangle, square, rectangle, hexagon, octagon, or the like. The dimensions of the cavities are selected to achieve this desired number of abrasive composites/square centimeter. The cavities can be present in a dot like pattern with spaces between adjacent cavities or the cavities can butt up against one another. It is preferred that the cavities butt up against one another.

The production tool can be a belt, a sheet, a continuous sheet or web, a coating roll such as a rotogravure roll, a sleeve mounted on a coating roll, or die. The production tool can be composed of metal, including a nickel-plated surface, metal alloys, ceramic, or plastic. Further information on production tools, their production, materials, etc. can be found in U.S. Pat. Nos. 5,152,917 (Pieper et al.) and 5,435,816 (Spurgeon et al.). One preferred production tool is a thermoplastic production tool that is embossed off of a metal master.

When the abrasive slurry comprises a thermosetting binder precursor, the binder precursor is cured or polymerized. This polymerization is generally initiated upon exposure to an energy source. In general, the amount of energy depends upon several factors such as the binder precursor chemistry, the dimensions of the abrasive slurry, the amount and type of abrasive particles and the amount and type of the optional additives. The radiation energy sources includes electron beam, ultraviolet light, or visible light. The radiation energy sources include electron beam, ultraviolet light, or visible light. Electron beam(ionizing)radiation can be used at an energy level of about 0.1 to about 10 Mrad, preferably at an energy level of about 0.1 to about 10 Mrad. Ultraviolet radiation refers to non-particulate radiation having a wavelength within the range of about 200 to about 400 nanometers, preferably within the range of about 250 to 400 nanometers. The preferred output of the radiation source is 118 to 236 Watt/cm. Visible radiation refers to non-particulate radiation having a wavelength within the range of about 400 to about 800 nanometers, preferably in the range of about 400 to about 550 nanometers.

A method of producing the preferred three dimensional abrasive article is illustrated in FIG. 3. Backing 51 leaves an unwind station 52 and at the same time the production tool (cavitated tool) 56 leaves an unwind station 55. Production tool 56 is coated with abrasive slurry by means of coating station 54. The coating station can be any conventional coating means such as drop die coated, knife coater, curtain coater, vacuum die coater, or a die coater. During coating the formation of air bubbles should be minimized. One coating technique is a vacuum fluid bearing die, which can be of the type such as described in U.S. Pat. Nos. 3,594,865; 4,959,265 and 5,077,870.

After the production tool is coated, the backing 51 and the abrasive slurry are brought into contact by any means such that the abrasive slurry wets the front surface of the backing. In FIG. 3, the abrasive slurry is brought into contact with the backing by means of contact nip roll 57. Next, contact nip roll 57 also forces the resulting construction against support drum 53. Next, some form of radiation energy, such as described herein, is transmitted into the abrasive slurry by energy source 63 to at least partially cure the binder precursor. For example, the production tool can be transparent material (e.g. polyester, polyethylene or polypropylene) to transmit light radiation to the slurry contained in the cavities in the tool as the tool and backing pass over roll 53. The term partial cure is meant that the binder precursor is polymerized to such a state that the abrasive slurry does not flow when the abrasive slurry is removed from the production tool. The binder precursor can be fully cured by any energy source after it is removed from the production tool. Following this, the production tool is rewound on mandrel 59 so that the production tool 56 can be reused again. Additionally, abrasive article 60 is wound on mandrel 61. If the binder precursor is not fully cured, the binder precursor can then be fully cured by either time and/or exposure to an energy source.

Other details on the use of a production tool to make the abrasive article according to this preferred method is further described in U.S. Pat. Nos. 5,152,917 (Pieper et al.), where the coated abrasive article that is produced is an inverse replica of the production tool, and 5,435,816 (Spurgeon et al.).

In another variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above. Relative to this method, it is preferred that the binder precursor is cured by radiation energy. The radiation energy can be transmitted through the backing and/or through the production tool. If the radiation energy is transmitted through either the backing or production tool then, the backing or production tool should not appreciably absorb the radiation energy. Additionally, the radiation energy source should not appreciably degrade the backing or production tool. For instance ultraviolet light can be transmitted through a polyester backing.

Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. In some instances, it is preferred to incorporate ultraviolet light stabilizers and/or antioxidants into the thermoplastic production tool. The more deformable material results in easier processing. For thermoplastic based production tools, the operating conditions for making the abrasive article should be set such that excessive heat is not generated. If excessive heat is generated, this may distort or melt the thermoplastic tooling.

After the abrasive article is made, it can be flexed and/or humidified prior to converting into a suitable form/shape before the abrasive article is used.

Another method to make an abrasive article is to bond a plurality of abrasive agglomerates to a backing. These abrasive agglomerates comprise a plurality of abrasive particles bonded together to form a shaped mass by means of a first binder. The resulting abrasive agglomerates are then dispersed in a second binder precursor and coated onto a backing. The second binder precursor is solidified to form a binder and the abrasive agglomerates are then bonded to the backing.

The abrasive agglomerates can include the optional additives as discussed. The abrasive agglomerates should have a desired rate of erodibility such that they break down during usage. Again, this erodibility rate can be determined by the abrasive particle type, first binder type, additive types and ratios thereof.

Abrasive agglomerates can be made by any conventional process such as those detailed in U.S. Pat. Nos. 4,311,489; 4,652,275, 4,799,939, and 5,500,273 all incorporated herein by reference.

The abrasive agglomerates are dispersed in a second binder precursor to form an abrasive slurry. The remaining steps to make the abrasive article can be the same as that discussed herein. Alternatively, the abrasive slurry can be applied onto the backing as knife coated, roll coated, sprayed, gravure coated, die coated, curtain coated or other conventional coating techniques. Then the abrasive slurry is exposed to an energy source to cure the binder precursor and convert the abrasive slurry into an abrasive composite.

Method of Making a Non-Precise Shaped Abrasive Composite

Another method for making an abrasive article pertains to a method in which the abrasive composites formed are not precisely shaped, i.e., they have an irregular shape. In this method, the abrasive slurry is exposed to an energy source once the abrasive slurry is removed from the production tool. The first step is to coat one side of the backing with an abrasive slurry by any conventional technique such as drop die coater, gravure coater roll, knife coater, curtain coater, vacuum die coater, or a die coater. If desired, it is possible to heat the abrasive slurry and/or subject the slurry to ultrasonics prior to coating to lower the viscosity. Next, the abrasive slurry/backing combination is brought into contact with a production tool. The production tool can be the same type of production tool described above. Again, it includes a series of cavities and the abrasive slurry flows into these cavities. Upon removal of the abrasive slurry/backing from the production tool, the abrasive slurry will have a textured pattern associated with it, i.e., the pattern of abrasive composites formed from the cavities. Following removal, the patterned abrasive slurry/backing is exposed to an energy source to initiate the polymerization of the binder precursor and thus forming the abrasive composites. It is generally preferred that the time between the removal of the patterned abrasive slurry/backing to curing the binder precursor is relatively minimal. If this time is too long, the pattern in the abrasive slurry will distort to such an extent as to substantially disappear.

Another embodiment of this method is to apply the abrasive slurry to the production tool cavities first. The backing is then brought into contact with the coated production tool so that the abrasive slurry wets and adheres to the backing. In this embodiment, the production tool may be a rotogravure roll. The remaining steps to make the abrasive article are, from this point on, the same as described above. After the abrasive article is made, it can be flexed and/or humidified prior to converting.

Yet another embodiment of this method is to spray or coat the abrasive slurry through a screen to generate a pattern and the abrasive composites. The binder precursor is then cured or solidified to form the abrasive composites.

Embossed Backings

There is another technique to make an abrasive article that has an abrasive pattern or texture associated with it. A backing can be provided that is embossed or has a contoured pattern. An abrasive slurry is coated over this backing and the slurry will follow the contour of the embossed backing to provide a pattern or textured coating. Additional information on making a textured abrasive containing an embossed backing can be found in U.S. Pat. Nos. 3,246,430 (Hurst); 3,991,527 (Maran); and 5,015,266 (Yamamoto).

Still another method to make an abrasive article is described in U.S. Pat. No. 5,219,462 (Bruxvoort et al.), which describes coating an abrasive slurry into the recesses of an embossed backing. The abrasive slurry includes abrasive particles, binder precursor and an expanding agent. The resulting construction is exposed to conditions such that the expanding agent causes the abrasive slurry to expand above the front surface of the backing. Next the binder precursor is solidified to form the abrasive composites.

In yet a further method, the abrasive slurry is formed into spheres or beads such as available in a commercially available product 3M IMPERIAL BEADED MICROFINISHING FILM, manufactured by Minnesota Mining & Manufacturing, St. Paul Minn. U.S.A. This product has beads of binder and abrasive particles bonded to a backing by means of a make and size coat.

Method of Refining a Workpiece

The method of the present invention relates to a method and an article for rapidly polishing a glass workpiece surface using a textured abrasive article including cerium oxide particles dispersed in a binder. The grinding and polishing of optical quality surfaces are important processes in producing acceptable surfaces on optical components such as lenses, prisms, mirrors, CRT tubes, windshields, windows, glass computer discs, glass photographic and picture frames and the like. Windows and windshields can be automotive windows, bus windows, train windows, air craft windows, home windows, office windows and the like. Such materials can be polished by the present invention.

After the second or final fining step, an Ra of about 0.06 to 0.13 micrometer, or an Rtm of 0.40 to 1.4 micrometer. This surface finish level must be decreased to about 0.30 micrometer or less Rtm after the polishing step in order for the surface to be rendered optically acceptable or so that optional surface coatings may be applied to the polished glass. Additionally, wild scratches, swirl marks, or indentations are generally unacceptable. A polishing machine that can be used in the present invention can be any machine designed to accept a fixed abrasive pad, i.e., a lap means. Examples of lapping machines suitable for performing the polishing of the present invention include: Coburn 5000 cylinder machine, Coburn 5056 cylinder machine, or Coburn 507 all available from Coburn Optical Industries, Inc., Muskogee, Okla.; and other known machines in the industry. Pressure applied to the abrasive article is believed to aid in the breakdown or erosion of the abrasive article being used. Erosion will vary for types of abrasive article. Overall, the pressure used will depend on the polishing equipment used, the initial surface finish of the glass workpiece, the abrasive particle size, and the desired final surface finish of the glass workpiece.

For other types of glass materials, rotating flat or hemispherical laps are used. These laps are support pads for the abrasive articles of the invention. In still other polishing operations, various "off hand" grinders or devices are used. These off hand grinders can have a fluid or water feed through the center of the rotating disc, as described in U.S. Pat. No. 4,523,411 (Freerks).

The actual time needed for glass workpiece polishing depends on the size of the surface area to be polished, pressure being used, initial surface finish of the glass workpiece, the abrasive particle size, and the desired final surface finish of the glass workpiece. An experienced machine operator will be able to determine the correct time and pressure required to obtain the desired final glass workpiece finish.

The lap means is supplied with water during the polishing procedure of the present invention. The aqueous flow applied in using the polishing sheet or pad of this invention is preferably predominantly water but may also include other ingredients as typically used in slurry polishing or in conventional coated abrasive finishing. Such additives may include water soluble oils, emulsifiable oils, wetting agents, and the like. The aqueous flow is at least essentially free of abrasive particles, and preferably contains no abrasive particles.

It is understood that no additional abrasive particles are applied to the liquid, the polishing is accomplished by the abrasive article and the integral slurry at the glass workpiece/abrasive article interface. In any event, abrasive articles are not present in the liquid as initially applied, i.e., supplied from a source external to the polishing interface.

After the glass workpiece is polished to a surface finish of about 0.30 micrometer or less Rtm according to the present invention, a coating can be optionally applied over the polished surface of the glass workpiece to protect the finish. This coating can be a scratch-resistant coating, an anti-reflective coating, paint or a decorative coating. This coating will of course depend upon the end use of the glass surface and the demands of the consumer/end user of the finished product.

The following non-limiting examples will further illustrate the invention. All parts, percentages, ratios, and the like, in the examples are by weight unless otherwise indicated.

EXAMPLES

The following abbreviations are used throughout:

TMPTA: trimethylol propane triacrylate, available from Sartomer under the trade designation "SR 351";

PEG: polyethylene glycol, commercially available from Union Carbide under the trade designation CARBOWAX 600;

BP1: a pentaerythritol tetraacrylate commercially available from Sartomer Co., Inc., Exton, Pa., under the trade designation "SR 295";

BP2: a 2-phenoxyethyl acrylate resin commercially available from Sartomer, Co., Inc., under the trade designation "SR 339";

PH2: 2-benzyl-2-N,N-dimethylamino-1-(4-morpholinophenyl)-1-butanone, commercially available from Ciba Geigy Corp. under the trade designation "Irgacure 369";

PPF: a 76 micrometer thick (3 mil thick) polyester film containing an ethylene acrylic acid co-polymer primer on the front surface;

CA1: a 3-methacryloxypropyltrimethoxysilane coupling agent commercially available from OSI Specialities, Inc., Danbury, Conn. under the trade designation "A-174";

CA2: an isopropyl triisostearoyl titanate coupling agent commercially available from Kenrich Petrochemicals I.

HDDA: hexanediol diacrylate commercially available from Sartomer Co., Inc., under the trade designation "Sartomer 238";

CACO: calcium carbonate filler having an average particle size of about one micrometer, commercially available from Pfizer Speciality Minerals, New York, N.Y. under the trade designation "Superflex 200";

PH3: 2-isopropylthioxanthone commercially available from Biddle-Sawyer Corp., New York, N.Y. (Distributor for Octel Chemicals, United Kingdom) under the trade designation "QUANTICURE ITX";

PH4: ethyl-4-(dimethylamino)benzoate photoinitiator commercially available from Biddle-Sawyer Corp. under the trade designation "EPD";

PH5: 2:1:2 ratio of PH2:PH3:PH4;

PH7: 2,4,6-trimethylbenzoyl-diphenyl-phosphine oxide liquid photoinitiator commercially available from BASF, Charlotte, N.C. under the trade designation "Lucirin LR 8893";

CEO1: ceria abrasive particles having an average particle size of about 0.5 micrometer, commercially available from Rhone Poulene, Shelton, Conn.;

SCA: silane coupling agent, 3-methacryloxypropyl trimethoxysilane, commercially available from Union Carbide under the trade designation "A-174";

ASF1: amorphous silica filler, commercially available from DeGussa under the trade designation "Aerosil 130"; and APS: an anionic polyester surfactant commercially available from ICI Americas, Inc., Wilmington, Del., under the trade designation "FP4" and "PS4".

Rtm

Rtm is a common measure of roughness used in the abrasives industry, however, the exact measuring procedure can vary with the type of equipment utilized in surface roughness evaluation. As used herein, Rtm measurements are based on procedures followed with the Rank Taylor Hobson profilometer located in Leicester, England, available under the trade designation SURTRONIC 3. Within the Rank Taylor Hobson preview, Rt is defined as the maximum peak-to-valley height within an assessment length set by the Rank Taylor Hobson instrument. Rtm is the average, measured over five consecutive assessment lengths, of the maximum peak-to-valley height in each assessment length. Rtm is measured with a profilometer probe which, for the SURTRONIC 3, is a 5 micrometer radium diamond tipped stylus and the results are recorded in micrometers ($\mu$m).

Ra

Ra is defined as an average roughness height value of an arithmetic average of the departures of the surface roughness profile from a mean line on the surface, also measured in micrometers ($\mu$m).

Preparation of the Abrasive Articles

The abrasive article for Example 1 was prepared from the abrasive slurry formulation described in Table 1.

TABLE 1

| Material | weight % |
|---|---|
| BP1 | 6.85 |
| BP2 | 6.85 |
| CA1 | 0.84 |
| APS | 1.26 |
| PH7 | 0.47 |
| CEO1 | 83.74 |

The abrasive article for Example 1 was prepared from the cerium oxide slurry having the formulation above. The abrasive slurry was prepared by mixing the ingredients above in a low shear planetary mixer for 5–10 minutes, where the order of addition of the ingredients was BP1, BP2, CA1, PH7 and APS. The planetary blade speed was 24 rpm while the mixing speed was about 1000 rpm. This mixing was accomplished at a temperature of about 40° C. After these ingredients were thoroughly mixed (5–10 min.), the CEO1 was gradually added to this mixture. The speed of the mixer was increased to 1800 rpm so that medium shear mixing occurred. This mixture was mixed approximately 10–20 minutes. Once the CEO1 was well dispersed, the speed of the mixer was increased to 2587 rpm and it was mixed for approximately 60 minutes.

A production tool was made by casting a polypropylene material on a metal master tool having a casting surface including a collection of adjacent truncated pyramids. The resulting production tool contained cavities that were in the shape of truncated pyramids. The pyramidal pattern was such that their adjacent bases were spaced apart from one another no more than about 510 micrometers (0.020 inch). The height of each truncated pyramid was about 80 micrometers, the base was about 178 micrometers per side and the top was about 51 micrometers per side. There were about 50 lines/centimeter delineating the array of composites.

The abrasive article was made on a machine similar to that illustrated in FIG. 3. This process was carried out in a class 10,000 clean room. The production tool produced above was unwound from a winder. The abrasive slurry, mixed above, was coated at room temperature and applied into various cavities of the production tool using a vacuum slot die coater. Next, the PPF backing was brought into contact with the abrasive slurry coated production tool such that the abrasive slurry wetted the front surface of the backing having the ethylene acrylic acid copolymer primer. An ultraviolet light radiation was then transmitted through the backing and into the abrasive slurry. Two different ultraviolet (UV) lamps were used in series.

The first UV lamp was a Fusion System ultraviolet light that used a "V" bulb and operated at 236.2 Watts/cm (600 Watts/inch). The second UV lamp was an ATEK ultraviolet lamp that used a medium pressure mercury bulb and operated at 157.5 Watts/cm (400 Watts/inch). Upon exposure to the UV light, the binder precursor was converted into a binder and the abrasive slurry was converted into a precisely shaped abrasive composite; together making a polishing layer which was cured in the tool.

The production tool was then removed from the polishing layer and the production tool was rewound. The precisely shaped abrasive composite/backing formed the abrasive article and this was wound on a core. This process was a continuous process that operated at about 3 meters/minute (10 feet/minute). The abrasive article was then heated for about 2 minutes at a temperature from 110 to 115.5° C. (230–240° F.) to activate the primer on the PPF backing. As state above, the abrasive article produced in this manner includes precisely shaped abrasive composites.

Example 2 used the same formulation as shown in Table 1 and under the same slurry production parameters as in Example 1. However, Example 2 was cured out of the tool. First the slurry, as described in Example 1, was coated into the cavities of a production tool by hand, which included pouring the slurry behind a knife coating blade with a 25.4 micrometer (1 mil) gap between the knife and the production tool. The PPF backing was brought into contact with the abrasive slurry coated production tool. The slurry wetted the front surface of the PPF backing having the primer. The abrasive slurry was then removed from the cavities by removing the production tool from the slurry/backing composite. Ultraviolet light was then transmitted into the abrasive slurry. Here, as above, two UV lamps were used, however, both lamps were 2 V bulbs (236.5 Watts/cm) used in series. Curing the abrasive article out of the tool cause the abrasive composite pyramids to slump which yielded a textured polishing layer rather than having precise abrasive composites.

An abrasive article, Comparative Example A, was prepared from the slurry formulation as shown below in Table 2.

TABLE 2

| Material | weight % |
|---|---|
| TMPTA | 4.2 |
| HDDA | 12.6 |
| PH5 | 1.1 |
| CA2 | 1.4 |
| CA1 | 4.2 |
| CEO1 | 70.0 |
| CACO | 6.5 |

The abrasive slurry was prepared by first mixing the TMPTA, HDDA, PH5, and CA2 at low shear for 20 minutes. Then the CEO1 was added and mixed for 15 minutes at 1725 rpm. The CA1 was added and was mixed for 5 minutes at 1725 rpm and then the CACO was added and was mixed for 10 minutes at 2400 rpm.

An abrasive article was produced using this abrasive slurry as described for Example 1, i.e., the curing occurred in the tool but the UV curing was through the production tool rather than through the backing, as described above. The resulting product is currently available from 3M, St. Paul, Minn. under the trade designation 3M 568XA CEO POLISH PAD.

Another abrasive article, Comparative Example B, was prepared using the formulation shown in Table 3.

TABLE 3

| Material | weight % |
|---|---|
| TMPTA/PEG (70/30) | 30.4 |
| PH2 | 0.6 |
| SCA | 0.8 |
| ASF1 | 1.2 |
| CEO1 | 67.0 |

The abrasive article was prepared under the conditions as described for Comparative Example A. However, because Comparative Example B was adapted from a formulation utilizing white aluminum oxide abrasive particles (as described in EP 650803, page 55). The amount of cerium oxide particles was calculated to yield the same volume percent as the formulation with white aluminum oxide (i.e., about 28% volume). However, the formulation having the cerium oxide particles in this amount was not mixable and, therefore, the amount of cerium oxide particles was reduced until the formulation became mixable, which was about 67.0 wt. % as shown in Table 3.

Polishing Test Procedure

The following test procedure was used to evaluate the polishing capabilities of the abrasive articles. A COBURN 507 polishing machine, available from Coburn Optical Industries, Inc., Muskogee, Okla., was modified to accept a 5 cm (2 inch) diameter glass test blank ring and the standard abrasive support pad was replaced with a 10 cm (4 inch) diameter flat aluminum lap. The spindle speed was 665 rpm, the stroke length was set at 0, and the orbit stroke length was about 0.78 inch, which was a setting of 7. All polishing was performed under a slow liquid supply, i.e. 0.25 grams of water was squirted onto the abrasive article/glass test blank interface every 5 seconds. The polishing was performed at a contact pressure 105 kPa (15 psi) at the interface between the abrasive article and the glass test blank.

A glass test blank was placed into the COBURN 507 polishing machine. The glass test blanks used were PYREX 7740 glass ring, available from Houde Glass Company, Newark, N.J. Each glass ring had an outer diameter of 5.015 cm (2.010 inch), an inner diameter of 4,191 cm (1.650 inch), a surface area of 13.567 $cm^2$ (1.03 $inch^2$), and a height of 1.27 cm (0.5 inch).

The glass test blank was initially fined for approximately 2 minutes with a 30 micrometer silicon carbide abrasive article, commercially available from 3M, St. Paul, Minn., under the trade designation IMPERIAL MICROFINISHING FILM 468 L. Each glass test blank was then secondarily fined for a time sufficient to generate an initial or input Rtm from about 1.0 to about 1.4 $\mu$m, which was generally a time of about 2 to 3 minutes. The secondary fining was done with a 15 micrometer silicon carbide abrasive article commercially available from 3M, under the trade designation IMPERIAL MICROFINISHING FILM 468L.

The surface finish, i.e. Rtm as described above, of the glass test blank was determined by measurements taken on the SURTRONIC 3 profilometer described above. These measurements were made from the profilometer. The "input " finish on the test blank surface, i.e. the Rtm measurement from the polishing performed with the silicon carbide abrasive articles, was recorded.

The glass test blank were then polished for about 1 minute (60 seconds) with the abrasive articles described in Examples 1, 2 and Comparative Examples A and B (in triplicate polishing runs). After about 1 minute, the polishing was stopped and the glass test blank surface finish, or Rtm, was determined as described for the input Rtm measurements except 6 measurements were taken for each polished glass test blank. This procedure was repeated after an approximate second and third minute of polishing.

Average Roughness Height values, or Ra, as described above were also determined for each polished glass test blank at an "input," 1 minute, 2 minutes and 3 minutes of polishing time.

The finish surface results from polishing with the abrasive articles of the present invention and Comparative Examples A and B are shown below in Table 4 for Rtm and Table 5 for Ra measurements.

TABLE 4

| | Rtm | | | |
|---|---|---|---|---|
| Example | Input | 1 Minute | 2 Minutes | 3 Minutes |
| 1 | 1.50, 1.18, 0.73, 1.20, 1.68, 1.50, 1.63, 1.50, 1.38 | 0.07, 0.20, 0.18, 0.18, 0.08, 0.17, 0.14, 0.09, 0.12, 0.33, 0.21, 0.14, 0.10, 0.22, 0.06, 0.08, 0.06, 0.23 | 0.07, 0.15, 0.10, 0.08, 0.10, 0.07, 0.08, 0.10, 0.10, 0.10, 0.09, 0.11, 0.13, 0.08, 0.09, 0.11, 0.08, 0.07 | 0.09, 0.10, 0.08, 0.08, 0.08, 0.08, 0.08, 0.09, 0.06, 0.09, 0.10, 0.08, 0.10, 0.08, 0.08, 0.06, 0.07, 0.08 |
| Average | 1.364 | 0.148 | 0.095 | 0.082 |
| 2 | 1.00, 1.18, 1.20, 1.73, 1.20, 0.80, 1.08, 1.45, 1.08 | 0.39, 0.12, 0.50, 0.36, 0.11, 0.20, 0.41, 0.10, 0.11, 0.34, 0.15, 0.16, 0.11, 0.12, 0.41, 0.40, 0.19, 0.25 | 0.25, 0.09, 0.10, 0.43, 0.13, 0.13, 0.08, 0.15, 0.11, 0.11, 0.16, 011, 0.11, 0.26, 0.18, 0.17, 0.37, 0.11 | 0.10, 0.23, 0.08, 0.10, 0.10, 0.10, 0.09, 0.13, 0.10, 0.11, 0.08, 0.14, 0.09, 0.08, 0.09 0.10, 0.09, 0.19 |
| Average | 1.189 | 0.246 | 0.169 | 0.111 |
| A | 1.23, 1.08, 0.93, 0.70, 1.18, 1.33, 1.35, 1.58, 0.98 | 0.39, 1.33, 0.56, 0.11, 0.36, 0.25, 0.93, 0.18, 0.15, 1.28, 1.05, 0.53, 1.06, 1.11, 0.25, 0.66, 1.15, 0.68 | 0.19, 0.16, 0.15, 0.65, 0.18, 0.12, 0.64, 0.16, 1.05, 0.10, 0.13, 0.90, 0.61, 1.06, 0.76, 0.28 0.15, 0.20 | 0.48, 0.28, 0.13, 0.42, 0.10, 0.17, 1.08, 0.22, 0.15, 0.33, 0.91, 0.09, 0.11, 0.40, 1.19, 0.15, 0.22, 0.59 |
| Average | 1.147 | 0.666 | 0.416 | 0.390 |
| B | 1.30, 1.48, 1.05, 0.63, 1.45, 1.38, 1.10, 1.08, 1.68 | 0.22, 0.53, 0.15, 0.10, 0.37, 0.65, 0.44, 0.12, 0.72, 0.34, 0.71, 0.10, 0.47, 0.68, 0.53, 0.21, 0.67, 0.36 | 0.16, 0.21, 0.22, 0.77, 0.60, 0.18, 0.22, 0.37, 0.36, 0.11, 0.13, 0.45, 0.11, 0.40, 0.19, 0.10, 0.10, 0.13 | 0.11, 0.10, 0.18, 0.13, 0.10, 0.09, 0.10, 0.09, 0.10, 0.10, 0.09, 0.11, 0.22, 0.12, 0.09, 0.08, 0.15, 0.10 |
| Average | 1.236 | 0.409 | 0.267 | 0.114 |

TABLE 5

| | | Ra | | |
|---|---|---|---|---|
| Example | Input | 1 Minute | 2 Minutes | 3 Minutes |
| 1 | 0.10, 0.13, 0.08, 0.13, 0.13, 0.13, 0.13, 0.18, 0.10 | 0.02, 0.02, 0.02, 0.02, 0.02, 0.01, 0.02, 0.02, 0.02, 0.02, 0.02, 0.02, 0.02, 0.02, 0.02, 0.02, 0.02, 0.02 | 0.02, 0.02, 0.02, 0.02, 0.02, 0.01, 0.02, 0.02, 0.02, 0.02, 0.02, 0.02, 0.03, 0.02, 0.02, 0.02, 0.02, 0.02 | 0.03, 0.01, 0.02, 0.02, 0.02, 0.01, 0.02, 0.02, 0.02, 0.02, 0.03, 0.02, 0.02, 0.02, 0.02, 0.02, 0.02, 0.02 |
| Average | 0.119 | 0.019 | 0.020 | 0.020 |
| 2 | 0.10, 0.13, 0.13, 0.18, 0.10, 0.08, 0.08, 0.13, 0.08 | 0.02, 0.03, 0.03, 0.02, 0.02, 0.02, 0.03, 0.02, 0.02, 0.03, 0.03, 0.02, 0.02, 0.02, 0.03, 0.04, 0.04, 0.04 | 0.02, 0.02, 0.02, 0.04, 0.02, 0.02, 0.02, 0.02, 0.02, 0.02, 0.03, 0.02, 0.02, 0.04, 0.03, 0.03, 0.03, 0.02 | 0.02, 0.03, 0.02, 0.02, 0.02, 0.02, 0.02, 0.02, 0.02, 0.02, 0.02, 0.02, 0.02, 0.02, 0.02, 0.02, 0.02, 0.02 |
| Average | 0.108 | 0.027 | 0.024 | 0.021 |
| A | 0.10, 0.10, 0.08, 0.08, 0.10, 0.13, 0.13, 0.13, 0.05 | 0.03, 0.16, 0.04, 0.02, 0.04, 0.03, 0.05, 0.02, 0.02, 0.09, 0.07, 0.03, 0.09, 0.05, 0.02, 0.04, 0.09, 0.04 | 0.03, 0.02, 0.02, 0.06, 0.02, 0.03, 0.04, 0.02, 0.05, 0.02, 0.02, 0.05, 0.03, 0.09, 0.04, 0.02, 0.03, 0.03 | 0.06, 0.05, 0.03, 0.05, 0.02, 0.02, 0.05, 0.02, 0.02, 0.03, 0.09, 0.02, 0.02, 0.02, 0.07, 0.02, 0.02, 0.03 |
| Average | 0.097 | 0.052 | 0.034 | 0.036 |
| B | 0.13, 0.13, 0.10, 0.05, 0.13, 0.10, 0.10, 0.10, 0.13 | 0.07, 0.05, 0.02, 0.02, 0.09, 0.04, 0.02, 0.02, 0.05, 0.02, 0.04, 0.02, 0.03, 0.03, 0.04, 0.04, 0.07, 0.02 | 0.02, 0.04, 0.03, 0.03, 0.03, 0.02, 0.02, 0.03, 0.02, 0.02, 0.02, 0.03, 0.02, 0.02, 0.02, 0.02, 0.02, 0.02 | 0.02, 0.02, 0.02, 0.02, 0.02, 0.02, 0.02, 0.02, 0.02, 0.02, 0.02, 0.02, 0.02, 0.02, 0.02, 0.02, 0.02, 0.02 |
| Average | 0.106 | 0.038 | 0.024 | 0.020 |

The data shown in Tables 4 and 5 demonstrate that a finer surface finish was achieved more rapidly with both examples of the abrasive article of the present invention when compared to abrasive articles exemplified by Comparative Examples A and B.

Figure 4:
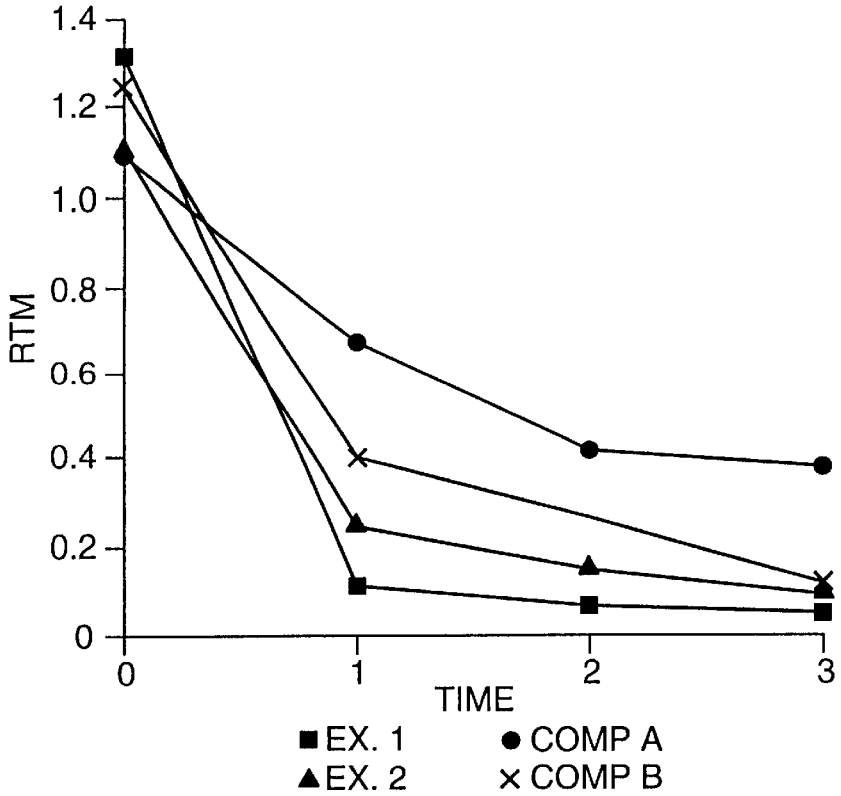
FIG. 4 is a plot of average Rtm values of Table 4 versus time
Figure 5:
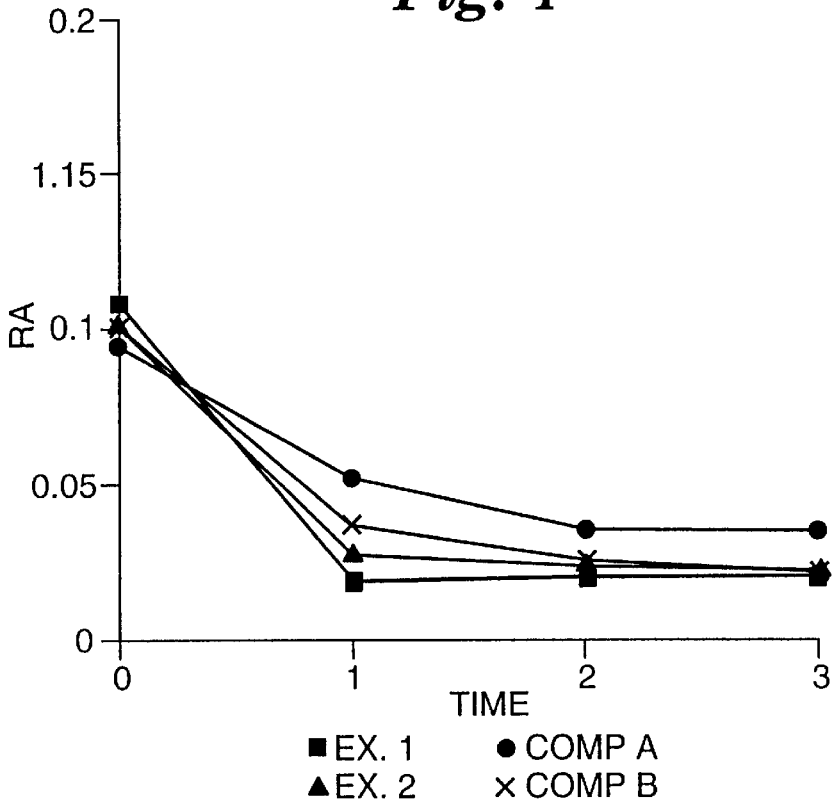
FIG. 5 is a plot of average Ra values of Table 5 versus time.

FIGS. 4 and 5 graphically show the averages of the data shown in Tables 4 and 5, respectively. The graphs the average Rtm, FIG. 4, or Ra, FIG. 5, values on the abscissa versus polishing time along the ordinate, with "Input" at time 0 minutes. FIG. 4 graphically illustrates the surprisingly shorter period of polishing time required to achieve an Rtm value of less than 0.30. In fact, after only 1 minute of polishing time, the average Rtm values for abrasive articles in Examples 1 and 2 were below 0.30, while the abrasive articles in Comparative Examples A and B were about 0.67 and 0.41, respectively. A polishing time of 3 minutes was needed for Comparative Example A approach an average 0.30 Rtm value and a 2 minute polishing time was needed for Comparative Example B. The rapid polishing rate is also borne out in FIG. 5, where after a polishing time of 1 minute, Comparative Example A has an average Ra value nearly two times greater than Example 2, in which the abrasive composites are not precisely shaped.

It was then evaluated whether the rapid polishing observed above was independent of the contact pressure at the interface between the abrasive article and the glass test blank. Polishing experiments were then carried out as described above except the contact pressure at the interface between the abrasive article tested and the glass test blank was reduced to 70 kPa (10 psi). Tables 6 and 7 show Rtm and Ra results, respectively.

TABLE 6

| | | Rtm | | |
|---|---|---|---|---|
| Example | Input | 1 Minute | 2 Minutes | 3 Minutes |
| 1 | 0.96, 1.40, 1.20, 1.18, 0.88, 1.43, 1.83, 1.20, 1.63 | 0.10, 0.10, 0.10, 0.24, 0.11, 0.09, 0.18, 0.28, 0.46, 0.14, 0.14, 0.20, 0.18, 0.36, 0.54, 0.14, 0.38, 0.09 | 0.09, 0.09, 0.09, 0.12, 0.10, 0.10, 0.15, 0.12, 0.11, 0.17, 0.11, 0.10, 0.11, 0.13, 0.15, 0.10, 0.10, 0.11 | 0.10, 0.10, 0.11, 0.10, 0.09, 0.10, 0.09, 0.11, 0.10, 0.11, 0.09, 0.10, 0.10, 0.07, 0.09, 0.09, 0.11, 0.08 |
| Average | 1.264 | 0.213 | 0.114 | 0.097 |
| 2 | 1.58, 1.13, 1.45, 1.45, 1.23, 0.95, 0.70, 1.85, 0.88 | 0.10, 0.20, 0.74, 0.65, 0.24, 0.12, 0.61, 0.70, 0.27, 0.31, 0.39, 0.28, 0.18, 0.11, 0.19, 0.17, 0.16, 0.39 | 0.14, 0.14, 0.10, 0.10, 0.23, 0.13, 0.12, 0.23, 0.17, 0.28, 0.11, 015, 0.13, 0.10, 0.10, 0.10, 0.17, 0.35 | 0.10, 0.17, 0.26, 0.11, 0.16, 0.16, 0.11, 0.13, 0.16, 0.23, 0.12, 0.12, 0.11, 0.27, 0.12 0.13, 0.10, 0.11 |
| Average | 1.244 | 0.323 | 0.154 | 0.148 |
| A | 0.85, 1.35, 0.90, 0.98, 1.10, 1.08, | 0.35, 0.87, 1.23, 1.14, 0.53, 0.32, | 1.25, 0.54, 0.36, 0.96, 0.91, 0.70, | 0.74, 0.69, 0.11, 0.19, 0.38, 0.76, |

TABLE 6-continued

| Example | Input | Rtm 1 Minute | 2 Minutes | 3 Minutes |
|---|---|---|---|---|
| | 1.38, 0.91, 1.20 | 0.77, 0.76, 0.98, 0.97, 1.24, 0.88, 1.55, 0.87, 0.50, 0.87, 0.51, 0.38 | 0.13, 0.95, 0.89, 0.87, 0.66, 0.50, 0.50, 0.80, 0.83, 0.96 0.24, 0.57 | 0.54, 1.01, 1.03, 0.37, 0.39, 0.71, 0.26, 0.78, 1.00, 0.73, 0.10, 0.41 |
| Average | 1.089 | 0.818 | 0.701 | 0.567 |
| B | 1.18, 1.63, 1.40, 0.78, 1.15, 1.03, 1.48, 1.50, 1.70 | 0.29, 0.92, 0.67, 0.45, 0.25, 0.61 0.39, 0.37, 0.22, 0.27, 0.29, 0.18 0.11, 1.18, 0.95, 0.19, 0.22, 0.50 | 0.18, 0.34, 0.48, 0.13, 0.14, 0.19 0.26, 0.35, 0.20, 0.20, 0.12, 0.14 0.16, 0.22, 0.13, 0.89, 0.08, 0.51 | 0.18, 0.45, 0.24, 0.61, 0.53, 0.15 0.16, 0.17, 0.14, 0.17, 0.11, 0.24 0.13, 0.16, 0.19, 0.10, 0.24, 0.15 |
| Average | 1.314 | 0.448 | 0.262 | 0.229 |

TABLE 7

| Example | Input | Ra 1 Minute | 2 Minutes | 3 Minutes |
|---|---|---|---|---|
| 1 | 0.08, 0.18, 0.10, 0.13, 0.08, 0.18, 0.13, 0.10, 0.18 | 0.02, 0.01, 0.02, 0.03, 0.02, 0.02, 0.02, 0.02, 0.02, 0.02, 0.02, 0.02, 0.02, 0.03, 0.03, 0.03, 0.03, 0.02 | 0.02, 0.02, 0.02, 0.02, 0.02, 0.02, 0.02, 0.02, 0.02, 0.02, 0.02, 0.02, 0.02, 0.02, 0.02, 0.02, 0.02, 0.02 | 0.02, 0.02, 0.02, 0.02, 0.02, 0.02, 0.02, 0.02, 0.02, 0.02, 0.02, 0.02, 0.02, 0.02, 0.02, 0.02, 0.02, 0.02 |
| Average | 0.125 | 0.022 | 0.020 | 0.020 |
| 2 | 0.18, 0.13, 0.10 0.10, 0.08, 0.08, 0.05, 0.13, 0.05 | 0.02, 0.02, 0.04, 0.05, 0.02, 0.02, 0.03, 0.04, 0.03, 0.03, 0.03, 0.03, 0.03, 0.03, 0.02, 0.02, 0.02, 0.03 | 0.03, 0.02, 0.02, 0.02, 0.02, 0.02, 0.02, 0.03, 0.03, 0.03, 0.03, 0.02, 0.03, 0.02, 0.02, 0.02, 0.02, 0.05 | 0.02, 0.02, 0.02, 0.03, 0.03, 0.02, 0.03, 0.03, 0.03, 0.02, 0.03, 0.02, 0.02, 0.02, 0.03, 0.02, 0.02, 0.02 |
| Average | 0.097 | 0.028 | 0.025 | 0.024 |
| A | 0.10, 0.13, 0.13, 0.08, 0.08, 0.08, 0.10, 0.13, 0.08 | 0.03, 0.05, 0.09, 0.07, 0.03, 0.03, 0.05, 0.03, 0.05, 0.07, 0.05, 0.04, 0.01, 0.04, 0.03, 0.05, 0.04, 0.02 | 0.07, 0.02, 0.03, 0.04, 0.09, 0.05, 0.02, 0.05, 0.05, 0.05, 0.03, 0.03, 0.03, 0.04, 0.04, 0.04, 0.02, 0.03 | 0.05, 0.04, 0.02, 0.02, 0.03, 0.05, 0.03, 0.05, 0.07, 0.03, 0.03, 0.05, 0.02, 0.03, 0.05, 0.04, 0.02, 0.02 |
| Average | 0.097 | 0.048 | 0.041 | 0.036 |
| B | 0.10, 0.13, 0.13, 0.08, 0.10, 0.13, 0.13, 0.13, 0.13 | 0.03, 0.05, 0.05, 0.03, 0.02, 0.03, 0.02, 0.03, 0.02, 0.02, 0.02, 0.02, 0.02, 0.04, 0.07, 0.02, 0.02, 0.03 | 0.02, 0.02, 0.02, 0.02, 0.02, 0.02, 0.02, 0.02, 0.02, 0.02, 0.02, 0.02, 0.02, 0.02, 0.02, 0.03, 0.02, 0.04 | 0.02, 0.02, 0.02, 0.03, 0.03, 0.02, 0.02, 0.02, 0.02, 0.02, 0.02, 0.02, 0.02, 0.02, 0.02, 0.02, 0.02, 0.02 |
| Average | 0.114 | 0.030 | 0.022 | 0.021 |

The data shown in Tables 6 and 7 demonstrate that the rapid polishing rate achieved by the abrasive article of the present invention is surprisingly independent of the contact pressure. While not wishing to be bound by theory, it is believed that these unexpected results were derived from the use of the binder in the abrasive article of the present invention. The binder in the abrasive article of the invention can be characterized as "hard" or "brittle" which aids in the erosion of the abrasive composites, thus may generate an in situ slurry-type matrix. It was seen that under either pressure conditions, the abrasive articles in accordance with Comparative Examples A and B did not yield surface finishes as fine the present invention after 3 minutes of polishing, even as compared to the surface finish produced after only one minute of polishing with the abrasive article of the present invention.

After one minute of polishing, the glass test blank were examined microscopically under 10× magnification. For such visual inspection, it was necessary to remove any loose abrasive and from the glass test blank and this was accomplished with a gentle stream of air and the glass test blank were then dried for about 1 hour at about 130° F. It was observed that Comparative Example B exhibited an irregular deposition of a wax-like substance on the glass test blank on about 5% to about 10% of the surface area polished. Areas of a dry white powder-like material was also seen. The waxy deposition was not seen with the abrasive article of the invention, i.e., Example 1. However, substantially the entire surface area polished with the abrasive article in accordance with the present invention was observed to have dry the white powder-like substance.

Polishing Life

The abrasive article of the present invention was then evaluated for polishing life. The polishing life was determined by using a screening-type polishing procedure. In this procedure, a 19 inch CRT panel glass workpiece was polished with an abrasive article disc having a center hole and dimensions 5 inches by 0.625 inches. An area of about 25 to 35 square inches was abraded with a FLEX SANDER LW603VR, available from Ackermann & Schmitt, Steinheim/Murr, Germany, at a speed for about 1600 to 1800 rpm with a structured abrasive pad available from 3M under the trade designation A 10 MIC 3M 268XA AO mounted on a medium-soft backup pad, 3M STIKIT DISC PAD CWF, available from 3M, St. Paul, Minn. These glass workpieces were now visually opaque and hazy. Abrasive articles as in Example 1 and Comparative Example A were used to evaluate the polishing life.

Example abrasive articles were mounted on the FLEX SANDER as described above. The glass workpiece was polished until visually clear. This abrading/polishing of the glass workpiece was repeated until breakdown of the abrasive article was not observed; typically at a point where the abrasive article did not move in a fluid motion relative to the glass workpiece and sticking and jerking was observed. It is believed that this condition is due to the complete breakdown of the fixed abrasive article resulting in a substantial elimination of the textured polishing layer. Additionally, the glass workpiece became hot and controlling the polisher became difficult. The time to polish each glass workpiece was measured so that the polishing rate (square inch per second) could be calculated. An average rate was calculated for each abrasive article tested. The complete breakdown of the textured polishing layer was roughly calculated to be a polishing rate of about 0.3 $in^2$/sec., i.e., this is the point where the test was stopped.

During this evaluation, it was observed that the abrasive article of Example 1 began to breakdown almost immediately upon contact with the wet glass test blank. Breakdown did not require any careful positioning of the polisher. Comparative Example A did not achieve good initial breakdown unless significant care was taken to position the polisher and control the water and pressure applied to the interface between the abrasive article and the glass test blank surface. Comparative Example B showed rapid initial breakdown and began to polish quickly. However, as the glass test blank surface became visually clear, the polisher became difficult to control and began to slide over the glass surface. A waxy or greasy appearance of the glass surface was noted and when water was applied to the surface, it tended to bead. It is believed that these observations may be due to the plasticizer present in the binder formulation in Comparative Example B. It was observed that the glass surface can be polished to visual clarity with increased polishing time using Comparative Example B.

Abrasive articles tested were made as described for Example 1 and Comparative Example A. The polishing life for each abrasive article was determined and the data shown in Table 8, were "total $in^2$" is the cumulative surface area polished by an individual abrasive article disc.

TABLE 8

| Example | Total $in^2$/disc | Range | Average Rate ($in^2$/sec) |
|---|---|---|---|
| 1 | 813 | | 0.65 |
| | 655 | | 0.62 |
| | 684 | | 0.71 |
| | 854 | | 0.63 |
| | 743 | | 0.65 |
| Average | 750 | 199 | 0.62 |
| A | 905 | | 0.58 |
| | 886 | | 0.51 |
| | 665 | | 0.55 |
| | 449 | | 0.70 |
| | 508 | | 0.68 |
| | 556 | | 0.72 |
| Average | 662 | 456 | 0.62 |

The data shown in Table 8 demonstrate that the polishing life of the abrasive article of the present invention is statistically the same as Comparative Example A. However, it was surprising that the measurements taken to determine the polishing life showed less variability and that more surface area on average appeared to be polished by an individual abrasive article of the present invention than that of Comparative Example A. It was surprisingly and unexpectedly found that not only does the abrasive article of the present invention achieve rapid polishing rates, but it at least has the same polishing life as the comparative abrasive article.

The effect of "breaking-in" an abrasive article was tested to examine whether the polishing rate changed over the life of the abrasive article. In this test, the abrasive article in Comparative Example A was tested in a subsequent polishing of a new glass test blank after initial breakdown. The abrasive articles were used to polish PYREX glass test blanks described above for about 1 minute and then new glass test blanks were subsequently polished using the same abrasive articles, i.e., the "old" abrasive articles. Rtm and Ra measurements were at two pressures, 10 psi and 15 psi. The data is shown in Tables 9 and 10, for measurements taken at 10 psi and 15 psi, respectively.

TABLE 9

| Rtm | | | Ra | | |
|---|---|---|---|---|---|
| Input | First Use | Reuse | Input | First Use | Reuse |
| 0.60, 0.73 | 1.29, 1.24, 0.53 | | 0.08, 0.08 | 0.05, 0.09, 0.04 | |
| 1.50, 1.20 | 0.47, 0.95, 2.61 | | 0.13, 0.13 | 0.03, 0.05, 0.14 | |
| 0.93, 1.88 | 0.97, 0.4, 0.67 | | 0.10, 0.13 | 0.09, 0.05 0.03 | |
| 1.65, 0.48 | 0.88, 0.99, 1.16 | | 0.13, 0.05 | 0.15, 0.05, 0.07 | |
| 0.85 | 0.57, 1.00, 1.31 | | 0.10 | 0.03, 0.09, 0.09 | |
| | 0.66, 0.22, 0.69 | | | 0.04, 0.02, 0.04 | |
| Ave.: | 0.927 | | 0.100 | 0.064 | |
| 1.089 | | | | | |
| 0.88, 1.08 | | 0.6, 0.47, 0.39 | 0.13, 0.23 | | 0.04, 0.03, 0.03 |
| 1.23, 1.63 | | 1.20, 0.55, 0.58 | 0.08, 0.13 | | 0.14, 0.03, 0.05 |
| 1.08, 1.08 | | 0.36, 0.76, 1.65 | 0.16, 0.10 | | 0.03, 0.04, 0.09 |
| 1.85, 1.20 | | 0.27, 0.80, 0.35 | 0.13, 0.13 | | 0.02, 0.04, 0.03, |
| 1.16 | | 0.35, 1.52, 0.79 | 0.18 | | 0.03, 0.09, 0.05 |
| | | 0.79, 0.34, 0.87 | | | 0.11, 0.02, 0.05 |
| Ave.: | | 0.702 | 0.139 | | 0.051 |
| 1.242 | | | | | |

TABLE 10

| Rtm | | | Ra | | |
|---|---|---|---|---|---|
| Input | First Use | Reuse | Input | First Use | Reuse |
| 0.53, 1.20 | 0.25, 0.56, 0.74 | | 0.05, 0.08 | 0.02, 0.09, 0.04 | |
| 0.93, 1.00 | 0.11, 0.56, 0.44 | | 0.05, 0.05 | 0.02, 0.05, 0.03 | |
| 1.00, 0.80 | 0.31, 0.77, 1.03 | | 0.10, 0.05 | 0.02, 0.03, 0.07 | |
| 1.18, 1.13 | 0.49, 0.63, 0.62 | | 0.10, 0.10 | 0.05, 0.04, 0.04 | |
| 0.73 | 0.42, 0.34, 1.00 | | 0.08 | 0.05, 0.03, 0.04 | |
| | 0.22, 0.34, 0.34 | | | 0.02, 0.02, 0.03 | |
| Ave.: | 0.509 | | 0.072 | 0.038 | |
| 0.942 | | | | | |
| 1.05, 0.63 | | 0.52, 0.42, 1.08 | 0.10, 0.05 | | 0.03, 0.03, 0.09 |
| 0.98, 0.95 | | 0.23, 0.50, 0.66 | 0.10, 0.06 | | 0.03, 0.03, 0.03, |
| 0.90, 0.80 | | 0.16, 0.31, 0.74 | 0.08, 0.08 | | 0.02, 0.02, 0.04 |
| 0.98, 0.80 | | 0.63, 0.42, 0.73 | 0.06, 0.10 | | 0.03, 0.03, 0.05, |
| 0.53 | | 0.23, 0.37, 0.35 | 0.05 | | 0.02, 0.02, 0.02 |
| | | 0.68, 0.46, 0.53 | | | 0.03, 0.03, 0.04 |
| Ave.: | | 0.501 | 0.076 | | 0.078 |
| 0.944 | | | | | |

The data shows that the polishing rate increased upon a second use of the abrasive article in Comparative Example A. However, when the "reuse" measurements are compared to the first use abrasive articles of the invention after 1 minute of polishing, as shown by the data in the column labeled "1 Minute" in Tables 4 and 5, lower Rtm and Ra values were selected with the abrasive article of the invention.

Patents and patent applications disclosed herein are hereby incorporated by reference. Other embodiments of the invention are possible. It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A method of polishing a glass workpiece using an abrasive article comprising:

a backing; and at least one polishing layer comprising cerium oxide particles dispersed within a binder, the binder bonded to a surface of the backing, the abrasive article is capable of reducing an initial Rtm of about 0.8 μm or greater on a glass test blank to a final Rtm of about 0.3 μm or less in about one minute using the RPE procedure.

2. An abrasive article comprising:

a backing having at least one surface; and at least one polishing layer bonded to the at least one surface of the backing, wherein the at least one polishing layer comprises a plurality of abrasive particles dispersed in a binder, the binder formed from a binder precursor comprising:

a tetra-functional acrylate monomer resin; and a mono-functional acrylate monomer resin.

3. The abrasive article of claim 2 wherein the plurality of abrasive particles comprise cerium oxide particles.

4. The abrasive article of claim 2 wherein the binder precursor further comprises from about 60 to about 40 parts tetra-functional acrylate monomer resin and from about 40 to about 60 parts mono-functional acrylate monomer resin.

* * * * *